US006705028B2

(12) United States Patent
Hanafusa et al.

(10) Patent No.: US 6,705,028 B2
(45) Date of Patent: Mar. 16, 2004

(54) SELF-PROPELLED SNOWPLOW VEHICLE

(75) Inventors: Jitsumi Hanafusa, Wako (JP); Kenji Kuroiwa, Wako (JP); Tsutomu Wakitani, Wako (JP); Tsutomu Inui, Wako (JP); Takahiro Yamamoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/238,802

(22) Filed: Sep. 10, 2002

(65) Prior Publication Data

US 2003/0046834 A1 Mar. 13, 2003

(30) Foreign Application Priority Data

Sep. 12, 2001 (JP) ..... 2001-276075
Sep. 28, 2001 (JP) ..... 2001-301013
Sep. 28, 2001 (JP) ..... 2001-301228

(51) Int. Cl.[7] ..... E01H 5/09
(52) U.S. Cl. ..... 37/246; 37/257
(58) Field of Search ..... 37/241, 246, 247, 37/249, 254, 257, 261, 244, 348, 382; 192/3.58, 56.4, 34; 701/50; 172/2

(56) References Cited

U.S. PATENT DOCUMENTS 3,886,675 A * 6/1975 Maisonneuve et al. ..... 37/211
4,391,052 A * 7/1983 Guy, Jr. ..... 37/236
4,651,452 A * 3/1987 Husso ..... 37/225
4,869,003 A * 9/1989 O'Loughlin ..... 37/255
5,865,016 A * 2/1999 Toman ..... 56/7
5,970,690 A * 10/1999 Toman ..... 56/7
6,154,985 A * 12/2000 Champagne et al. ..... 37/222
6,453,583 B1 * 9/2002 Hanafusa et al. ..... 37/246
6,470,603 B2 * 10/2002 Hanafusa et al. ..... 37/257
6,550,161 B2 * 4/2003 Hanafusa et al. ..... 37/246
6,556,143 B2 * 4/2003 Noah ..... 340/679
6,564,481 B2 * 5/2003 Wakitani et al. ..... 37/348

FOREIGN PATENT DOCUMENTS

JP 04194109 7/1992

* cited by examiner

*Primary Examiner*—Victor Batson
(74) *Attorney, Agent, or Firm*—Adams & Wilks

(57) ABSTRACT

A self-propelled snowplow vehicle includes a vehicle frame equipped with an auger at a front end portion thereof and pivotally connected to a propelling frame equipped with driving wheels, and a frame lift mechanism for lifting the front end portion of the vehicle frame up and down relative to the propelling frame. The frame lift mechanism comprises an electro-hydraulic cylinder actuator having a piston rod and an electric motor rotatably driven to produce a fluid pressure for reciprocating the piston rod in response to operation of a manual operating switch. The snowplow vehicle also includes a control unit arranged to forcibly stop the electric motor when a predetermined time has elapsed after the operation switch is activated, the predetermined time being equal to an operating time of the cylinder actuator which is required to extend or contract the piston rod over a maximum stroke defined between a fully extended position and a fully contracted position of the piston rod.

18 Claims, 17 Drawing Sheets

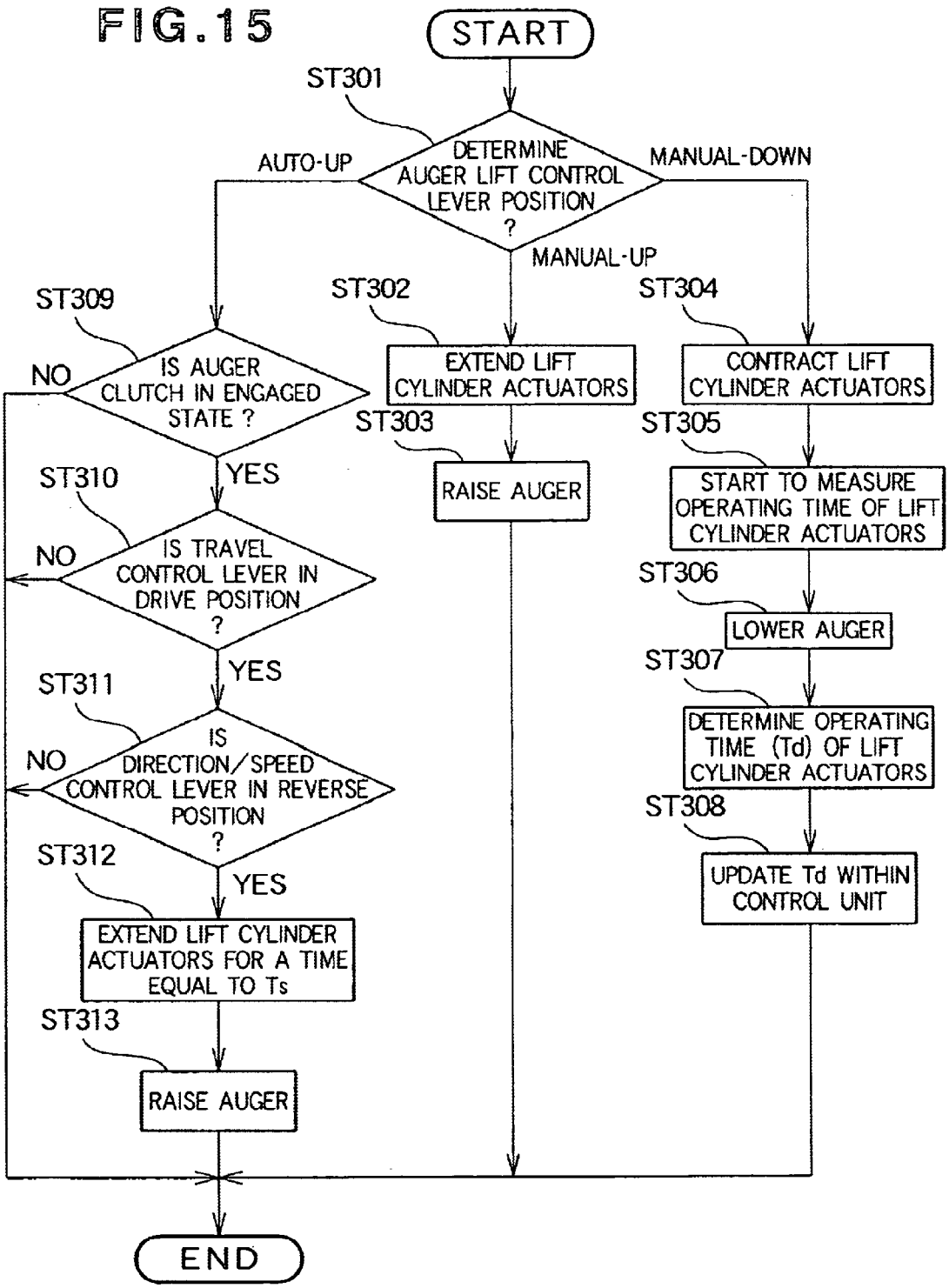
FIG.15
START
ST301
DETERMINE AUGER LIFT CONTROL LEVER POSITION ?
AUTO-UP
MANUAL-DOWN
MANUAL-UP
ST309
IS AUGER CLUTCH IN ENGAGED STATE ?
NO
YES
ST310
IS TRAVEL CONTROL LEVER IN DRIVE POSITION ?
NO
YES
ST311
IS DIRECTION/SPEED CONTROL LEVER IN REVERSE POSITION ?
NO
YES
ST312
EXTEND LIFT CYLINDER ACTUATORS FOR A TIME EQUAL TO Ts
ST313
RAISE AUGER
ST302
EXTEND LIFT CYLINDER ACTUATORS
ST303
RAISE AUGER
ST304
CONTRACT LIFT CYLINDER ACTUATORS
ST305
START TO MEASURE OPERATING TIME OF LIFT CYLINDER ACTUATORS
ST306
LOWER AUGER
ST307
DETERMINE OPERATING TIME (Td) OF LIFT CYLINDER ACTUATORS
ST308
UPDATE Td WITHIN CONTROL UNIT
END

SELF-PROPELLED SNOWPLOW VEHICLE

FIELD OF THE INVENTION

The present invention relates to a self-propelled snowplow vehicle having a driving wheel for driving the snowplow vehicle and an auger for removing snow.

DESCRIPTION OF THE RELATED ART

In a snowplow vehicle equipped with a snow-removing anger, a system is employed to ensure that the vertical level or height of the auger can be changed in view of snow-removing conditions. When the snowplow vehicle moves from one place to another, the auger is preferably kept in a raised position to facilitate smooth movement of the snowplow vehicle. On the other hand, when a snow-removing operation is to be achieved, the auger is preferably moved to a lower position to achieve the snow-removing operation with improved efficiency. During the snow-removing operation, the auger is frequently raised and lowered in harmony with angulations on the ground surface. Frequent rising and lowering operation of the auger, when achieved manually, is laborious. To lighten the load on the human operator, an improved self-propelled snowplow vehicle has been proposed, which is equipped with a power-operated vertically swingable auger, as disclosed in Japanese Patent Laid-open Publication No. HEI 4-194109.

The disclosed snowplow vehicle includes a propelling frame equipped with left and right crawler belts, a vehicle frame equipped with an auger and pivotally connected to the propelling frame, and a lift control device operable to lift a front end portion of the vehicle frame up and down relative to the propelling frame. The lift control device is comprised of a cylinder actuator operable, under the control of a control unit, to extend or contract its piston rod to thereby lift the vehicle frame front end portion and the auger in an upward or a downward direction in response to pivotal movement of a manual operating lever provided on an operating part of the snowplow vehicle.

The cylinder actuator constituting the lift control device needs a power source for operation thereof. In the case where the cylinder actuator is an oil hydraulic cylinder actuator, a separate hydraulic power unit must be provided. Accordingly, the overall size of the lift control device is relatively large. Thus, the use of the oil hydraulic cylinder actuator is quite disadvantageous when the snowplow vehicle is relatively small in size.

In order to achieve downsizing of the lift control device, use of an electro-hydraulic cylinder actuator may be considered. The electro-hydraulic cylinder actuator has an electric motor drivable to produce a hydraulic pressure used for reciprocating a piston rod of the cylinder actuator. The electric motor and a hydraulic power unit such as a pump are assembled with a cylinder of the cylinder actuator, so that the electro-hydraulic cylinder actuator is relatively small in size. The electric motor is controlled to extend or contract the piston rod of the cylinder actuator to thereby raise or lower the auger in response to on-off operation of an operation switch.

Since the height of the auger is changed in view of snow-removing conditions, it may occur that the operation switch is kept in the activated state even after the piston rod arrives at its fully extended or fully contracted position. On this occasion, the electric motor is subjected to a heavy load for a long time. Additionally, during snow-removing operation, since the height of the auger is frequently changed in harmony with angulations of the ground surface, the electro-hydraulic cylinder actuator is forced to operate repeatedly with high frequencies. Under such condition, the duty cycle of the electric motor is very high and generation of heat from the electric motor is promoted.

To deal with this problem, use of a continuously operable electric motor may be considered. The continuously operable electric motor is, however, expensive and hence increases the cost of the snowplow vehicle. As an alternative measure, use of a thermo-breaker may be considered for the purpose of protecting the motor from overheating. The thermo-breaker is generally built in the electric motor and operates to cut off or open a power supply circuit to the electric motor when the electric motor heats up above a given temperature.

The thermo-breaker is designed to continue the "open" state of the power supply circuit until the electric motor cools to a satisfactory operating temperature. Accordingly, a downtime occurs each time the thermo-breaker operates. In case where the operating temperature of the thermo-breaker is set to a relatively low value, the power supply circuit to the electric motor may be frequently cut off by the thermo-breaker. Alternatively, when the operating temperature of the thermo-breaker is set to a relatively high value, the power supply circuit to the electric motor may be cut off infrequently. In the latter case, however, the thermo-breaker requires a relatively long time to recover its original inoperating state. To enable smooth snow-removing operation, the frequency of operation of the thermo-breaker should preferably be reduced To this end, an arrangement may be considered, in which a detection switch is associated with the electro-hydraulic cylinder actuator such that when arrival of the piston rod of the cylinder actuator at its fully extended or fully contracted position is detected by the detection switch, the detection switch generates a signal to stop operation of the electric motor. This arrangement may reduce the occurrence of overloaded condition of the electric motor. However, use of the detection switch necessarily increases the number of parts of the cylinder actuator and requires an electric wiring system, leading to an increased cost of the snowplow vehicle.

FIGS. 16A to 16C are diagrammatical views illustrative of the operation of a conventional self-propelled snowplow vehicle 500. In FIG. 16A, the snowplow vehicle 500 is shown with a snow-removing auger 503 disposed in a lowermost horizontal position. The snowplow vehicle 500 is moving forward by the action of crawlers 501 (one being shown) while removing snow by means of the auger 503 and a blower 504 rotatably driven by an engine 502. The auger 503 collects snow and the blower 504 blows the collected snow away from the snowplow vehicle 500 through a shooter 505. In this instance, a travel control lever 511 provided on a control board 510 is disposed in an "F" (forward) position, and an auger lift control lever 512 also provided on the control board 510 is disposed in a "DN" (down) position.

Due to a large amount of snow to be removed or in order to change the advancing direction of the snowplow vehicle 500, the snowplow vehicle 500 is occasionally moved backward. In this instance, as shown in FIG. 16B, the travel control lever 511 on the control board 510 is shifted from the "F" (forward) position to an "N" (neutral) position as indicated by the arrow ① whereupon the snowplow vehicle 500 stops moving in the forward direction. Then, the auger lift control lever 512 is shifted from the "DN" (down)

position to an "UP" (up) position as indicated by the arrow ② whereupon lift cylinder actuators 506 (one being shown) operate to extend their piston rods to thereby lift a front end portion of a vehicle frame 508 upward relative to a propelling frame 507 on which the crawlers 501 (FIG. 16A) are mounted. The auger 503 is thus raised to an uppermost elevated inclined position.

Then as shown in FIG. 16C, the travel control lever 511 on the control board 510 is shifted from the "N" (neutral) position to an "R" (reverse) position as indicated by the arrow ③ whereupon the snowplow vehicle 500 moves backward. As described above, in order to reverse the snowplow vehicle while moving in the forward direction, the conventional snowplow vehicle requires three consecutive steps of manual operation as indicated by the arrows ①–③. Conversely, when the snowplow vehicle while moving backward is to be moved in the forward direction, the snowplow vehicle is first stopped from moving backward. Then, the auger is lowered from the uppermost inclined position to the lowermost horizontal position. Finally, the snowplow vehicle is moved in the forward direction. Thus, three consecutive steps of manual operation are also required. Due to complicated manual operations of the two levers 511, 512 to be done in a correct order, the maneuverability of the conventional snowplow vehicle is relatively low.

To deal with this problem, an improved snowplow vehicle has been proposed, wherein a snow-removing unit such as an auger is automatically raised when a reversing operation of the snowplow vehicle is selected, as disclosed in Japanese Utility Model Laid-open Publication No. SHO 64-28416. As shown in FIG. 17A, when a travel control lever 611 on a control board 610 is shifted to an "F" (forward) position, the snowplow vehicle 600 moves forward as indicated by the arrow while, at the same time, an auger 603 rotates to thereby achieve snow-removing operation. When the travel control lever 611 on the control board 610 is shifted to an "R" (reverse) position, as shown in FIG. 17B, the auger 603 is moved upward from the lowermost horizontal position of FIG. 17A through a neutral position (not shown) to an uppermost inclined position of FIG. 17B. Upon arrival of the auger 603 at the uppermost inclined position, rotation of the auger 603 is stopped by disengaging an auger clutch (not shown) disposed between the auger 603 and an engine (not designated). At the same time, the snowplow vehicle 600 is driven to move in the reverse direction as indicated by the arrow shown in FIG. 17B.

Since the auger 603 is lifted up to the uppermost inclined position each time the reverse position is selected by the travel control lever 611, this means that when the snowplow vehicle 600 is then to be moved forward to achieve a snow-removing operation, the auger 603 needs to be lifted down from the uppermost inclined position to the lowermost horizontal position. Due to a long downward stroke of the auger 603, an interruption occurs in the snow-removing operation each time the "F" (forward) position is selected immediately after the reversing mode of the snowplow vehicle. In other words, lifting of the auger 603 to the uppermost inclined position in preparation for the backward movement of the snowplow vehicle will lower the efficiency of the snow-removing operation. Due to this difficulty, the snowplow vehicle 500 shown in FIGS. 16A–16C is normally used notwithstanding the fact that the snowplow vehicle 500 is not satisfactory in terms of the maneuverability and lightening of load on the operator.

SUMMARY OF THE INVENTION

It is, accordingly, an object of the present invention to provide a self-propelled snowplow vehicle, which can be manufactured at a relatively low cost, is able to lighten the load on an electric motor of a electro-hydraulic cylinder actuator used to raise or lower a snow-removing member such as an auger, and is capable of achieving a snow-removing operation smoothly and efficiently.

According to the present invention, there is provided a self-propelled snowplow vehicle comprising: a propelling frame equipped with driving wheels for driving the snowplow vehicle; a vehicle frame equipped with an auger at a front end portion thereof for removing snow, the vehicle frame being pivotally connected to the propelling frame; a frame lift mechanism for lifting the front end portion of the vehicle frame up and down relative to the propelling frame, the frame lift mechanism including an electro-hydraulic cylinder actuator having a piston rod and an electric motor rotatably driven to produce a fluid pressure for reciprocating the piston rod between a fully contracted position and a fully extended position; an operation switch adapted to be manually activated to drive the electric motor in either direction; and a control unit for controlling operation of the electric motor thereby to control operation of the frame lift mechanism.

In one preferred form of the present invention, the control unit is arranged to forcibly stop the electric motor when a predetermined time has elapsed after the operation switch is activated, the predetermined time being equal to an operating time of the cylinder actuator which is required to extend or contract the piston rod over a maximum stroke defined between the fully extended position and fully contracted position.

By thus forcibly stopping the electric motor, it is possible to cut down the operating time of the electric motor. Since the electric motor is released from a heavily loaded condition soon after the arrival of the piston rod at its fully extended or contracted position, the load on the frame lift mechanism including the electric motor is lessened and the durability of the frame lift mechanism is increased.

Additionally, since the electric motor is stopped when the piston rod moves over the maximum stroke, generation of heat from the electric motor can be suppressed. The thermo-breaker built in the electric motor does not operate, so that the operator is allowed to continue snow-removing operation of the snowplow vehicle without considering a down-time of the snowplow vehicle which may occur when the thermo-breaker operates. The snow-removing operation can, therefore, be achieved smoothly and efficiently. Furthermore, the electro-hydraulic cylinder actuator (frame lift mechanism) can operate smoothly and reliably without requiring detection switches provided for detecting the piston rod arrived at the fully extended position and the fully contracted position. The snowplow vehicle is, therefore, formed by a reduced number of parts used and has a relatively simple electric wiring system. This achieves cost cutting of the snowplow vehicle.

It is preferable that the control unit continues to stop the electric motor when the operation switch is still in the activated state even after the lapse of the predetermined time.

When the operation switch is still in the activated state even after the electric motor is forcibly stopped upon the lapse of the preset reference time (which is equal to an operating time required for the electro-hydraulic cylinder actuator to move the piston rod over the maximum stroke), the control unit continues to stop the electric motor. Thus, a heavily loaded condition of the electric motor does not recur with the result that the total load exerted on the frame lift mechanism including the electric motor is reduced and the durability of the frame lift mechanism is increased. Additionally, since the thermo-breaker is kept in the off or inactivated state, a downtime does not occur. Thus, the snow-removing operation can be continued smoothly and efficiently.

In another preferred form of the present invention, the control unit is arranged to add up running times of the electric motor during which the electric motor is rotating and forcibly stop the electric motor when a total sum of the running times reaches a predetermined reference value. The predetermined reference value corresponds to a time which is required for the electric motor to heat up above a predetermined temperature. By forcibly stopping the electric motor, it is possible to protect the electric motor from overheating and eventually improve the durability of the electric motor. Additionally, the electric motor is stopped rapidly without operating the thermo-breaker built in the electric motor The control of the electric motor depends on time and does not rely on the thermo-breaker which requires a relatively long time for recover its original inoperating state. It is, therefore, possible to resume rotation of the electric motor in a relatively short period of time. Since snow-removing operation of the snowplow vehicle can be continued without considering a downtime which may occur when the thermo-breaker operates, the efficiency of the snow-removing operation is very high.

It is preferable that the total sum (Tm) of the running times is obtained by the expression $$Tm=Tr-Ts$$

where Tr represents an accumulated total of the running times during which the electric motor is rotating, and Ts represents an accumulated total of the rest times during which the electric motor is at a standstill.

It may be considered that the cumulative running time Tr is a total sum of the running times of the motor during which the electric motor heats up while it is rotating, and the cumulative rest time Ts is a total sum of the rest times of the motor during which the electric motor cools down while it is at a standstill. By using the integrated value or total sum Tm of rotating times which is represented by the expression Tm=Tr−Ts, control of the electric motor is achieved in close match with actual heat-developing and -releasing conditions of the electric motor. Since the cumulative rest time (heat-releasing time) Ts of the electric motor is subtracted from the cumulative running time (heat-developing time) Tr, it is possible to elongate the time during which the integrated value or total sum Tm of running times reaches the preset reference value. This means that the time period during which the motor continues to rotate before it is forcibly stopped can be extended. The snow-removing operation of the snowplow vehicle can be achieved with improved efficiency.

It is further preferable that the control unit continues to stop the electric motor until a preset fixed time has passed after forcible stop of the electric motor. Since the heat developed in the electric motor is further released, the electric motor is protected from overheating with higher safeness and hence has a higher degree of durability.

Preferably, the running times of the electric motor have a fixed value and are added up at the lapse of a unit time, and the rest times of the electric motor have a fixed value and are added up at the lapse of the unit time, and wherein the fixed value of the running times is larger than the fixed value of the rest times.

In still another preferred form of the present invention, the snowplow vehicle has three modes of operation including a manual-up mode in which the auger is raised manually, a manual-down mode in which the auger is lowered manually, and an auto-up mode in which the auger is automatically raised, wherein the control unit is arranged such that when the manual-down mode is selected, the control unit determines and stores an amount of contraction of the piston rod achieved in the selected manual-down mode, and when the manual-down mode is followed by the auto-up mode and information representing reversing of the direction of rotation of the driving wheels is received, the control unit performs an auto-up control of the piston rod in which the piston rod is extended by an amount equal to the amount of contraction of the piston rod determined with respect to the preceding manual-down mode.

The travel condition of the snowplow vehicle, which may occur immediately before the manual-down mode is selected, is considered to be a road traveling condition in which the snowplow vehicle travels on a road surface with the auger held in an uppermost position, or a reversing condition in which the snowplow vehicle travels backwards on a snow-covered road surface with the auger held in an elevated position intermediate between the uppermost inclined position and a lowermost horizontal position. The auger, as it is in the elevated intermediate position, does not interfere with snow while the snowplow vehicle is moving backward. From this, it is preferable that when the auto-up mode is selected, the auger is raised to the elevated intermediate position. The auger is thus automatically returned to the previous position, so that there is no possibility of interference occurring between the auger and snow when the snowplow vehicle is moving backward. Furthermore, at the time of forward movement of the snowplow vehicle, the auger is lifted down from the elevated intermediate position to the lowermost horizontal position. Thus, the time required for lowering the auger is reduced to one-half of the conventional snowplow vehicle discussed above with reference to FIGS. 17A and 17B, so that the efficiency of the snow-removing operation is increased correspondingly. In addition, since the auger is automatically lifted to the elevated intermediate position, the operator is not subjected to undue load or pressure.

It is preferable that the piston rod of the electro-hydraulic cylinder actuator is extended and contracted at the same speed, and the amount of contraction of the piston rod is determined depending on time. This arrangement obviates the need for a stroke sensor provided for measuring the amount of extension or contraction of the piston rod, which sensor is expensive, is susceptible to malfunction due to adhesion of snow or dirt, and requires wire harnesses.

Preferably, the self-propelled snowplow vehicle further includes an auger clutch disposed between a power source and the auger for transmitting rotational power from the power source to the auger, wherein when the auger clutch is in an disengaged state, the control unit disables the auto-up control of the piston rod of the cylinder actuator.

The above and other objects, features and advantages of the present invention will become manifest to those versed in the art upon making reference to the following description and accompanying sheets of drawings in which certain preferred structural embodiments incorporating the principle of the invention are shown by way of illustrative examples.

BRIEF DESCRIPTION OF THE DRAWINGS

FIG. 15 is a flowchart similar to FIG. 14, but showing a modified control procedure of the control unit;

DESCRIPTION OF THE PREFERRED EMBODIMENTS

The following description is merely exemplary in nature and is in no way intended to limit the invention or its application or use.

Figure 1:
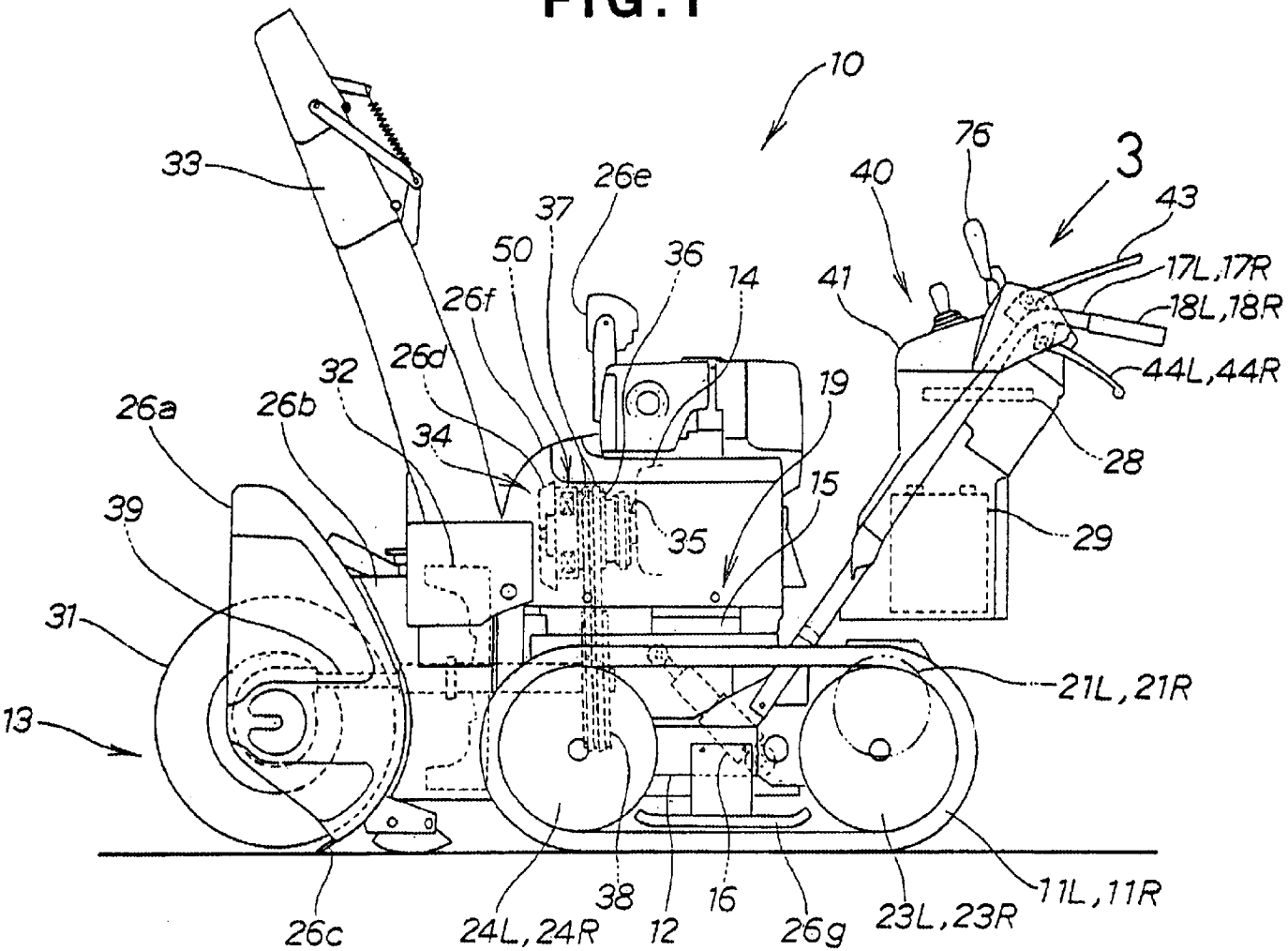
FIG. 1 is a side view of a walk behind self-propelled crawler snowplow vehicle according to an embodiment of the present invention.

Referring to the drawings and FIG. 1 in particular, there is shown a walk behind self-propelled crawler snowplow vehicle 10 according to an embodiment of the present invention. The snowplow vehicle 10 generally comprises a propelling frame 12 carrying thereon left and right crawler belts (only the left crawler belt 11L being shown), a vehicle frame 15 carrying thereon a snowplow mechanism 13 and an engine (prime motor) 14 for driving the snowplow mechanism 13, a frame lift mechanism 16 operable to lift a front end portion of the vehicle frame 15 up and down relative to the propelling frame 12, and a pair of left and right operation handlebars 17L and 17R extending from a rear portion of the propelling frame 12 obliquely upward in a rearward direction of the snowplow vehicle 10. The operation handlebars 17L, 17R each have a grip 18L, 18R at the distal end (free end) thereof The propelling frame 12 and the vehicle frame 15 jointly form a vehicle body 19. The propelling frame 12 also carries thereon left and right drive wheels 23L, 23R and left and right driven wheels 24L, 24R.

The operation handlebars 17L, 17R are adapted to be gripped by a human operator (not shown) walking behind the snowplow vehicle 10 in order to maneuver the snowplow vehicle 10. In the illustrated embodiment, a control board 41, a control unit 28 and batteries 28 are arranged in a vertical space defined between the left and right handlebars 17L, 17R and they are mounted to the handlebars 17L, 17R in the order named when viewed from the top to the bottom of FIG. 1.

The engine 14 serves as a power source for the snowplow mechanism 13 and generates motive power which is transmitted via a snowplow power transmission mechanism 34 to the snowplow mechanism 13. The snowplow power transmission mechanism 34 is arranged such that power from an output shaft (crankshaft) 35 of the engine 14 can be transmitted via a driving pulley 36 and a power transmission belt 37 to the snowplow mechanism 13. To this end, an electromagnetic clutch 45 is mounted on the output shaft 35 of the engine 14. The driving pulley 36 is freely rotatably mounted on the output shaft 35 of the engine 14 and is connected in driven relation to the output shaft 35 when the electromagnetic clutch 45 is actuated or placed in the engaged state.

The snowplow mechanism 13 has an auger 31, a blower 32 and a discharge duct or shooter 33 that are mounted to a front portion of the vehicle frame 15. The auger 31 and the blower 32 are rotatably mounted on a rotating shaft 39. The rotating shaft 39 has a driven pulley 38 connected in driven relation to the driving pulley 36 by means of the power transmission belt 37.

In operation, the power from the engine output shaft 35 is transmitted via the electromagnetic clutch 45 to the driving pulley 36, and rotation of the driving pulley 36 is transmitted via the power transmission belt 37 to the driven pulley 38. The driven pulley 38 is thus rotated. Rotation of the driven pulley 38 causes the rotating shaft 39 to rotate the auger 31 and the blower 32 concurrently. The auger 31 cuts snow away from a road surface, for example, and feeds the snow into the blower 32. The blower 32 blows out the snow through the discharge duct or shooter 33 to a distant place.

In FIG. 1, reference numeral 26*a* denotes an auger case, numeral 26*b* denotes a blower case, numeral 26*c* denotes a scraper formed integrally with a lower edge of the auger case 26*a*, numeral 26*d* denotes a charging generator for charging the batteries 29, numeral 26*e* denotes a lamp, numeral 26*f* denotes a cover for protecting the generator 26*d* and the electromagnetic clutch 50, and numeral 26*g* denotes a stabilizer for urging each crawler belt 11L, 11R downward against the ground surface.

Figure 2:
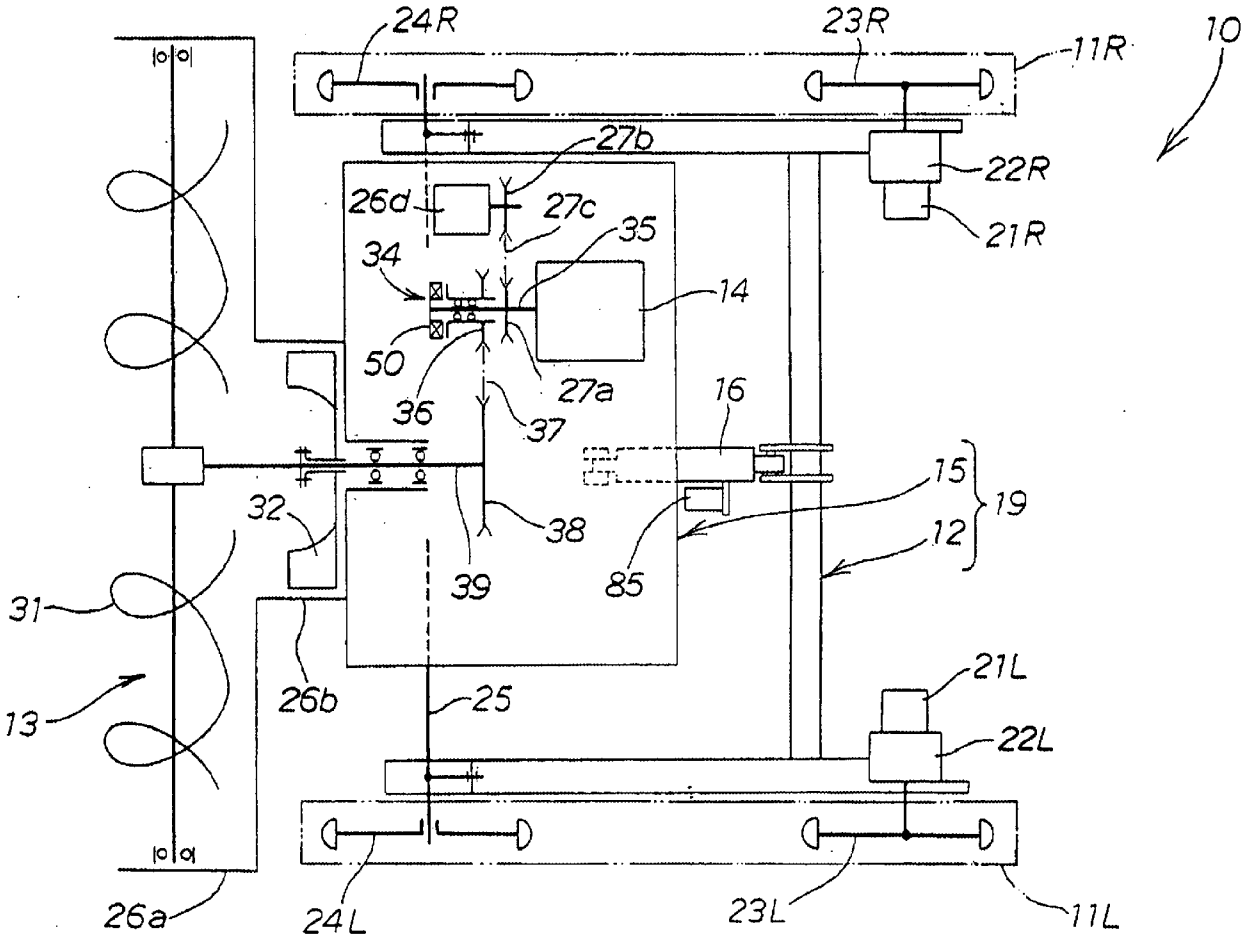
FIG. 2 is a diagrammatical plan view of the snowplow vehicle, showing a propelling power transmission line extending from electric motors to crawler belts and a snow-removing power transmission line extending from an engine to a snowplow mechanism.

As diagrammatically shown in FIG. 2, the left and right crawler belts 11L, 11R are driven by left and right electric motors 21L, 21R, respectively. The crawler belts 11L, 11R are each entrained around the driving wheel 23L, 23R and the driven wheel 24L, 24R provided in pair. The driving wheel 23L, 23R is disposed on a rear side of the crawler belt 11L, 11R, and the driven wheel 24L, 24R is disposed on a front side of the crawler belt 11L, 11R.

Power from each electric motor 21L, 21R is transmitted through a propelling power transmission mechanism 22L, 22R to the corresponding driving wheel 23L, 23R to thereby drive the associated crawler belt 11L, 11R. The propelling power transmission mechanism 21L, 22R comprises a speed reducer 22L, 22R assembled integrally with the electric motor 21L, 21R. The speed reducer 22L, 22R has an output shaft that forms a rear axle on which each driving wheel 23L, 23R is fixed. Thus, the left and right crawler belts 11L, 11R are separately drivable with power from the corresponding electric motors 21L, 21R. Reference numeral 25 denotes a front axle on which the left and right driven wheels 24L, 24R are rotatably mounted.

In order to drive the charging generator 26*d*, a generator driving pulley 27*a* is mounted to the engine output shaft (crankshaft) 35, and a generator driven pulley 27*b* is mounted to a shaft of the charging generator 26*d*. The driving and driven pulleys 27*a*, 27*b* are connected by a V-belt 27*c*, so that rotation of the engine output shaft 35 is transmitted to the charging generator 26*d*.

Figure 3:
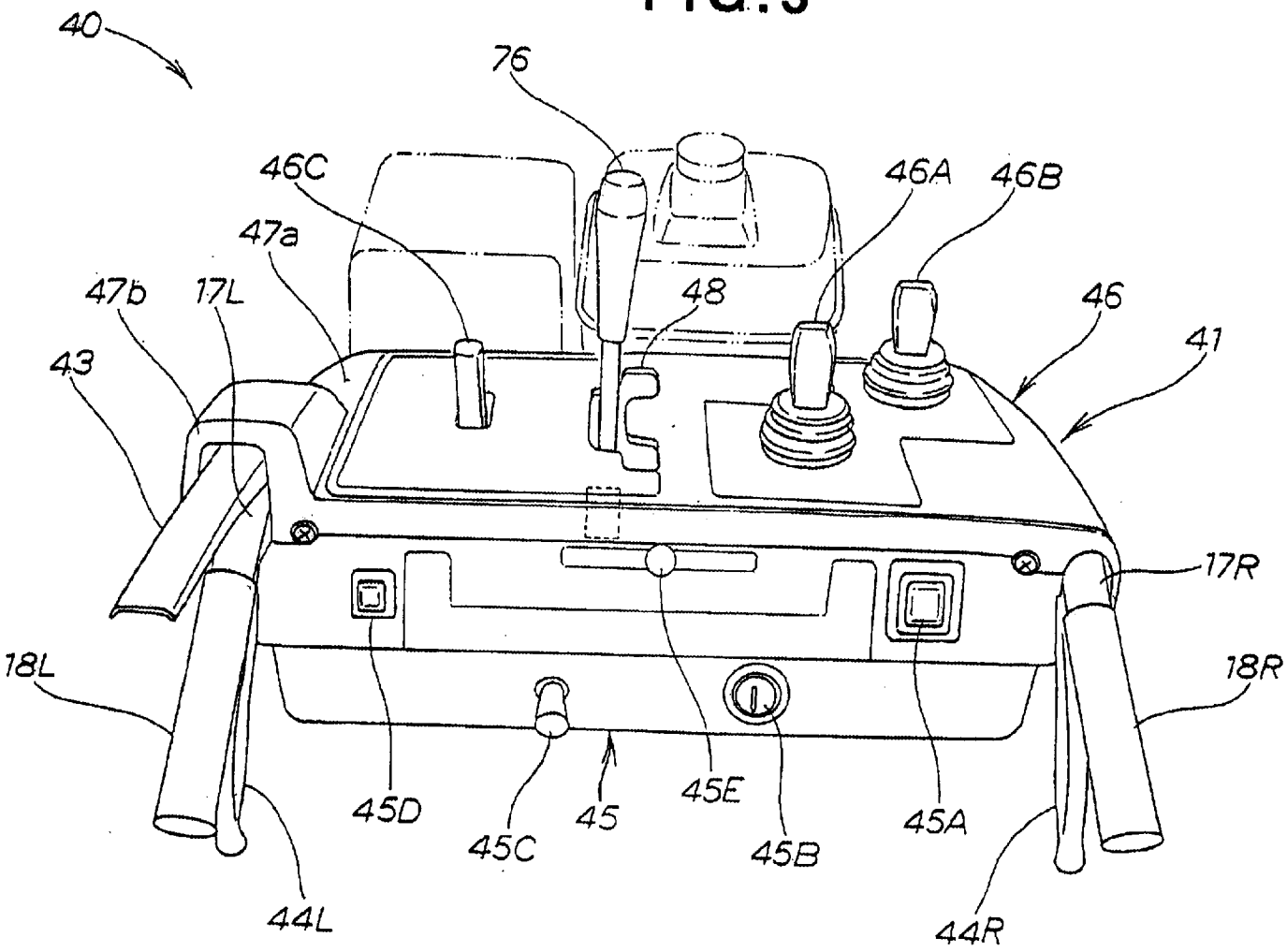
FIG. 3 is a view in the direction of the arrow 3 shown in FIG. 1.

FIG. 3 shows the general arrangement of an operating part 40 of the snowplow vehicle. The operating part 40 generally comprises the control board 41 disposed between the left and right handlebars 17L, 17R, a travel-ready lever 43 and a left turn control lever 44L that are mounted to the left handlebar 17L in the proximity of the grip 18L, and a right turn control lever 44R mounted to the right handlebar 17R in the proximity of the grip 18R. The travel-ready lever 43 is operated to place the snowplow vehicle 10 in a ready-to-travel condition.

The control board 41 is composed of a box-shaped body 45 extending between the left and right handlebars 17L, 17R, and a control panel 46 covering an upper opening of the box-shaped control board body 45. The body 45 is provided with an auger switch (clutch switch) 45A for switching on-off operation of the electromagnetic clutch 50 (FIG. 1), a main switch (key switch) 45B, a choke knob 45C that may be used when the engine 14 (FIG. 1) is started, a light button 45D for turning on and off the lamp 26*e* (FIG. 1), and a failure lamp 45D designed to be turned on when a failure occurs.

The control panel 46 is provided with a lift control lever 46A for controlling operation of the frame lift mechanism 16 (FIG. 1), a shooter control lever 46B for changing the direction of the shooter 33 (FIG. 1), a throttle lever 46C for controlling speed (revolutions per minute) of the engine 14, and a forward/reverse speed control lever 76 for controlling the direction and speed of the electric motors 21L, 21R (FIG. 1). The control panel 46 has a generally flat body portion 47*a* forming a major part of the control panel 46, a cover portion 47*b* of an inverted U-shaped cross section for covering the travel-ready lever 43, and a guide groove 48 formed in the body portion 47*a* for guiding movement of the forward/reverse speed control lever 76.

The lift control lever 46A has an auto-return mechanism so that when the lift control lever 46A is released from the human operator, it automatically returns to the original neutral position shown in FIG. 3. When the lift control lever 46A is pulled or tilted rearward of the snowplow vehicle, the frame lift mechanism 16 (FIG. 1) operates to raise the snowplow mechanism 13 (FIG. 1). Conversely, when the lift control lever 46A is pushed or tilted forward of the snowplow vehicle, the frame lift mechanism 16 operates to lower the snowplow mechanism 13.

Figure 4:
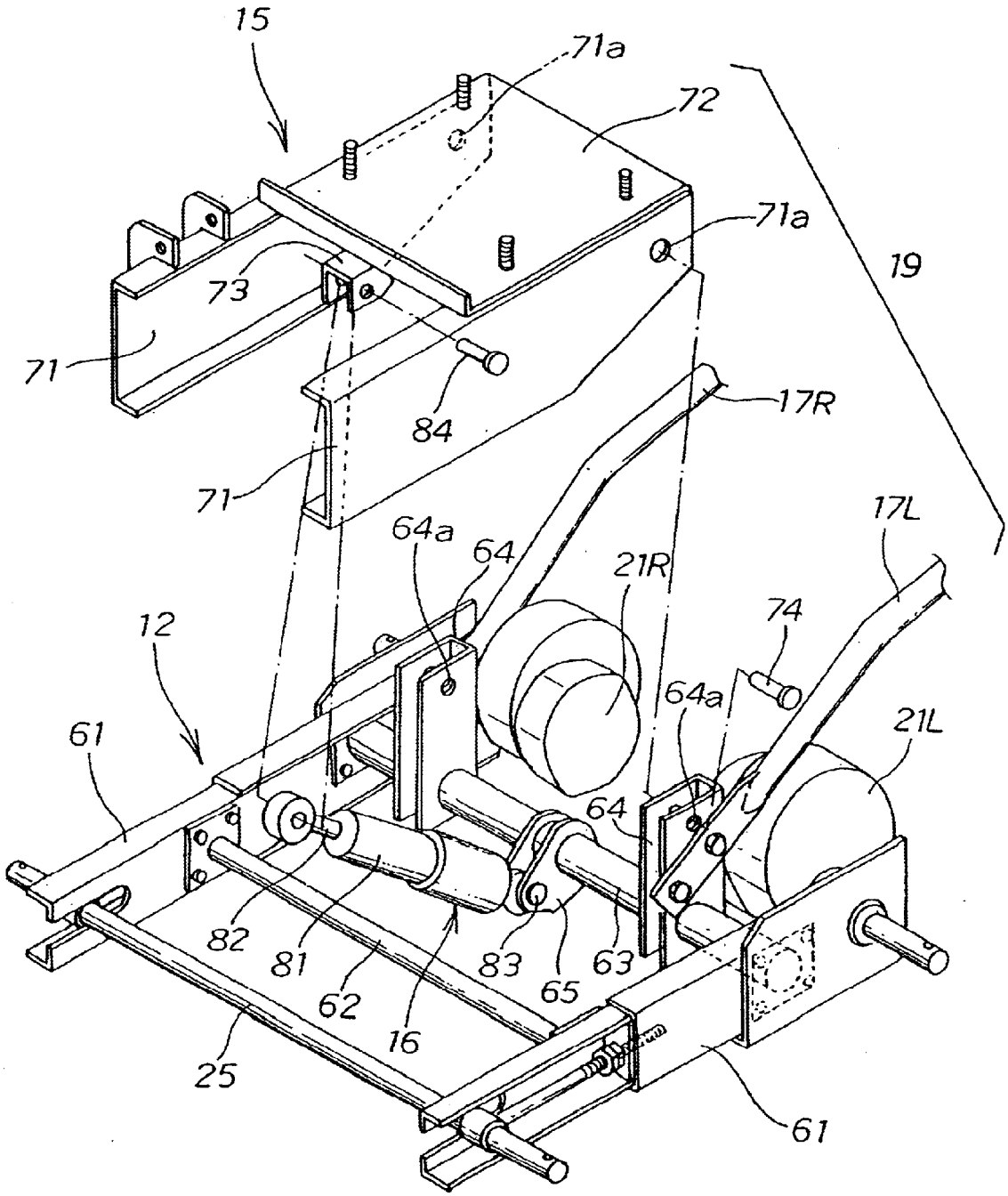
FIG. 4 is an exploded perspective view of a frame lift mechanism.

As shown in FIG. 4, the propelling frame 12 is composed of a pair of parallel spaced left and right side members 61, 61 extending in the longitudinal direction of the vehicle body 19, a front cross member 62 interconnecting respective front portions of the side members 61, 61, and a rear cross member 63 interconnecting respective rear portions of the side members 61, 61. The propelling frame 12 further has a pair of side brackets 64, 64 connected to left and right end portions of the rear cross member 63 adjacent to the side members 61, and a central bracket 65 connected to a central portion of the rear cross member 63 which corresponds in position to a widthwise central portion of the propelling frame 12.

The electric motors 21L, 21R assembled integrally with the speed reducers (not designated) are mounted to respective rear end portions of the side members 61, 61. The rear axles (not designated) that are formed by output shafts of the speed reducers are rotatably supported by the rear end portions of the side members 61, 61. Respective front end portions of the side members 61, 61 have a longitudinal slot (not designated) for receiving therein a longitudinal portion of the front axle 25 so that the front axle 25 is rotatably supported on the front end portions of the side members 61, 61.

The left and right side brackets 64 are each comprised of a vertically extending channel member having a U-shaped cross section. The left and right handlebars 17L, 17R have respective lower end portions bolted to the opposite outer sides of the left and right side brackets 64. The side brackets 64 each have a horizontal through-hole 64*a* formed in an upper end portion thereof The vehicle frame 15 is comprised of a pair of parallel spaced left and right side members 71, 71 extending in the longitudinal direction of the vehicle body 19, and a horizontal mount base 72 extending between the side members 71, 71 astride a rear half of the side members 71 for mounting the engine 14. The vehicle frame 15 also has a support arm 73 connected to a central portion of the front edge of the mount base 72. The side members 71 each have a horizontal through-hole 71*a* formed in a rear end portion thereof The vehicle frame 15 is pivotally connected to the propelling frame 12 by means of pivot pins 74 (one being shown) inserted successively through the horizontal through-holes 64*a* in the side brackets 64 and the horizontal through-holes 71*a* in the side members 71. With this pivotal connection, a front end portion of the vehicle frame 15 is movable up and down in a vertical plane relative to the propelling frame 12.

The frame lift mechanism 16 is comprised of a cylinder actuator having a cylinder tube 81 and a piston rod 82 reciprocally movable to project from or retract into the cylinder tube 81. The cylinder actuator is of the electro-hydraulic type, in which the piston rod 82 is reciprocated by a fluid pressure generated from a pump (not shown) driven by an electric motor 85 (FIG. 2). The electric motor 85 is mounted on one side of the cylinder tube 81.

The front end of the rod 82 is pivotally connected by a pin 84 to the support arm 73 of the vehicle frame 15, and the rear end of the cylinder tube 81 is pivotally connected by a pin 83 to the central bracket 65 of the propelling frame 12. With this arrangement, the vehicle frame 15 is movable to swing up and down in the vertical plane about the pivoted rear end portion thereof in response to extending and contracting movement of the cylinder actuator (frame lift mechanism) 16.

Figure 5A:
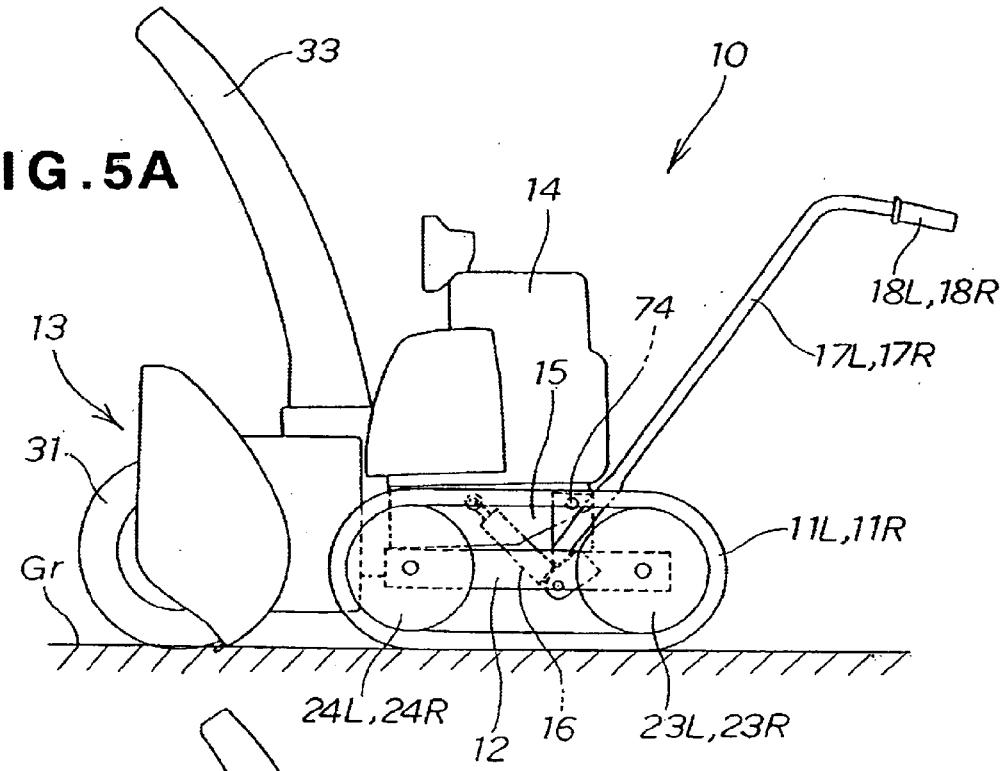
FIGS. 5A and 5B are diagrammatical side views illustrative of the operation of the frame lift mechanism.

The frame lift mechanism 16 of the foregoing construction operates as follows. As shown in FIG. 5A, when the cylinder actuator (frame lift mechanism) 16 of the snowplow vehicle 10 is in the fully contracted state (in which the piston rod 82 shown in FIG. 4 is disposed in a fully contracted position), the auger 31 of the snowplow mechanism 13 and the front portion of the vehicle frame 15 are disposed in a lowest horizontal position.

Figure 5B:
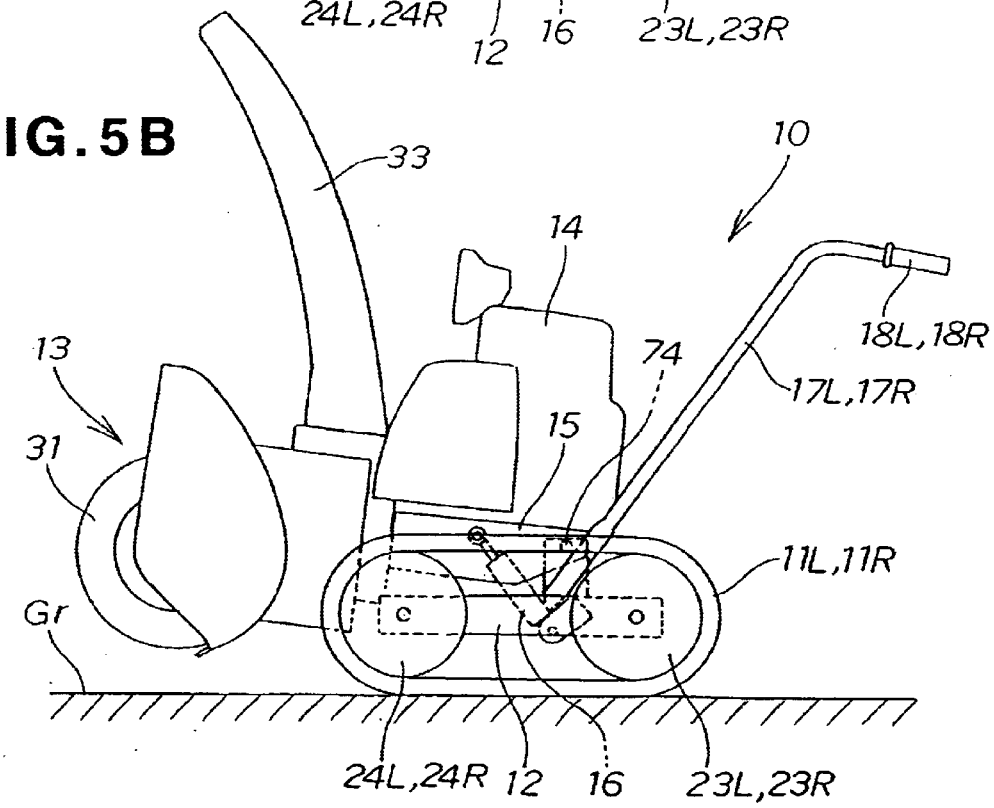

Conversely, as shown in FIG. 5B, when the cylinder actuator (frame lift mechanism) 16 is in the fully extended state (in which the piston rod 82 shown in FIG. 4 is disposed in a fully extended position), the auger 31 of the snowplow mechanism 13 and the front portion of the vehicle frame 15 are disposed in a highest inclined position.

Since the crawler belts 11L, 11R carried on the propelling frame 12 are in contact with the ground surface Gr, the height of the propelling frame 12 is always constant. On the other hand, the vehicle frame 15, which is pivotally connected by the pivot pins 74 to the propelling frame 12, is pivotally movable to swing up and down about the pivot pins 74 relative to the propelling frame 12.

It will be appreciated that by properly manipulating the lift control lever 46A (FIG. 3) so as to extend or contract the cylinder actuator (frame lift mechanism) 16, the vehicle body 15 swings up and down relative to the propelling frame 12 to thereby raise or lower the auger 31 of the snowplow mechanism 13 mounted to the front portion of the vehicle frame 15. When the snowplow vehicle 10 is to be moved from one place to another, the auger 31 is preferably disposed in the highest inclined position of FIG. 5B so as to enable the snowplow vehicle 10 to travel smoothly. During snow-removing operation of the snowplow vehicle 10, the auger 31 is preferably disposed in the lowest horizontal position of 5A so as to insure highly efficient snow-removing operation by the snowplow 31. It is preferable that during the snow-removing operation, the vertical position of the auger 31 is adjusted to accommodate angulations of the ground surface Gr.

The frame lift mechanism 16 and lift control lever 46A (FIG. 3) are operatively connected together so that when the lift control lever 46A (FIG. 3) returns to its original neutral position, the cylinder actuator (frame lift mechanism) 16 retains its length given at that time, thereby keeping a swing angle of the auger 31 and the vehicle frame 15 relative to the propelling frame 12.

Figure 6:
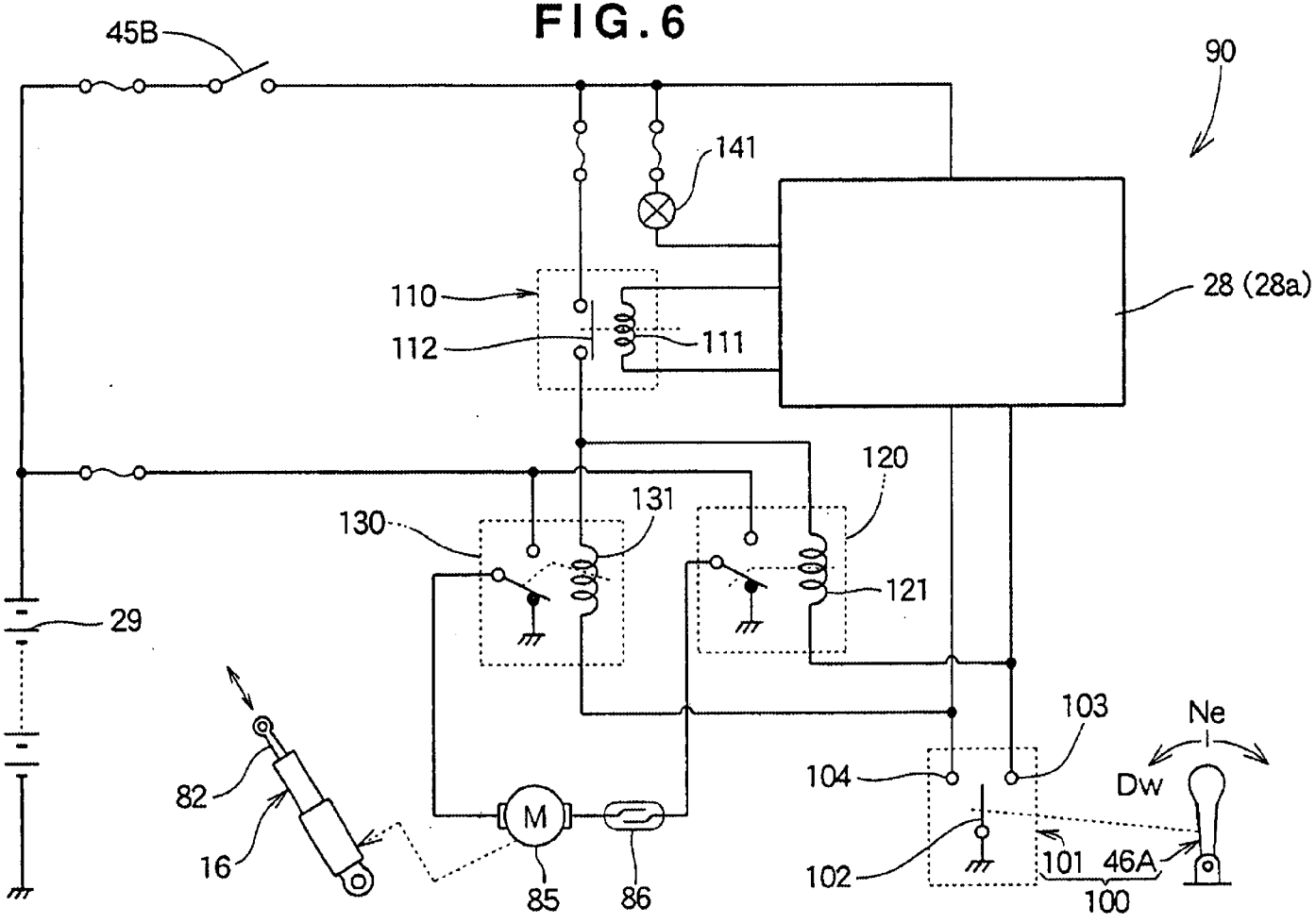
FIG. 6 is a circuit diagram including a control unit and related parts thereof.

FIG. 6 is a circuit diagram showing an electric circuit 90 including the control unit 28 and related parts thereof. The electric circuit 90 also includes an operation switch 100 connected directly to the control unit 28. In the electric circuit 90, the control unit 28, a control relay 110, an auger-up relay 120, an auger-down relay 130 and a control lamp 140 are connected via a main switch 45*b* to the batteries 29.

The operation switch 100 comprises a lift control switch composed of the lift control lever 46A and a switch mechanism 101 that are assemble together so as to control operation of the electric motor 85 of the frame lift mechanism 16.

The switch mechanism 101 of the lift control switch (operation switch) 100 has the function of a three-position toggle switch having a movable contact 102 and two fixed contacts 103, 104. The switch mechanism 101 and the lift control lever 46A are operatively connected together such that when the lift control lever 46A is in the neutral position Ne, the movable contact 102 of the operation switch 100 is also disposed in the neutral position where the movable contact 102 does not engage either of the two fixed contacts 103, 104. In this instance, the operation switch 100 is in the off state and no signal is generated from the operation switch 100. When the lift control lever 46A is pulled or tilted rearward (rightward in FIG. 6) to an up position Up, the movable contact 102 comes in contact with the first fixed contact 103. This makes the operation switch 100 turn on and an "on" signal is generated from the operation control switch 100. Similarly, when the lift control lever 46A is pushed or tilted forward (leftward in FIG. 6) to a down position Dw, the movable contact 102 comes in contact with the second fixed contact 104. This makes the operation switch 100 turn on and an "on" signal is generated from the operation switch 100.

The control unit 28 has a first function of forcibly stopping the electric motor 85 when a preset reference time T1 has passed after the operation switch 100 is turned on or activated (or when activation of the operation switch 100 continues till a lapse of the reference tim t1). The control unit 28 also has a second function of continuing stopping the electric motor 85 when the operation switch 100 is still in the activated state after a lapse of the reference time t1. The reference tim t1 is equal to an operating time of the cylinder actuator (frame lift mechanism) 16 which is required to move the piston rod 82 over a maximum stroke between the fully extended position and the fully contacted position.

The control unit 28 performs various control operations, as enumerated below.

(1) When the operation switch 100 is in the off state (i.e., in the absence of an "on" signal from the operation switch 100), an excitation coil 111 of the control relay 110 is kept de-energized to maintain the original "off" position of a normally open contact 112. The control relay 110 is thus kept in the off state.

(2) When the operation switch 100 is turned on or activated (that is, when an "on" signal is produced from the operation switch 100), the excitation coil 111 of the control relay 110 is energized to move the normally open contact 112 to an "on" or dosed position. The control relay 110 is thus turned on or activated.

(3) When the "on" signal from the operation switch 100 continues to present until the reference time T1 has elapsed after the operation switch 100 is turned on or activated, the excitation coil 111 of the control relay 110 is forcibly de-energized to return the normally open contact 112 to the original "off" or open position. The control relay 110 is thus forcibly turned off or deactivated (4) When the "on" signal from the operation switch 100 is still present even after the lapse of the reference time T1, the de-energized state of the excitation coil 111 is continued to thereby keep the "off" or open position of the contact 112. The control relay 110 is continuously held in the de-activated state.

(5) When the control relay 110 is in the on or activated state, this means that the electric motor 85 is operating or rotating. Under such condition, the control lamp 141 is in the on or activated state.

The auger-up relay 120 and the auger-down relay 130 are disposed between the control relay 110 and the operation switch 100 so that they operate under the control of the control relay 110 and the operation switch 100. Furthermore, the electric motor 85 and a thermo-breaker 86 for protection of the electric motor 85 are also disposed between the auger-up relay 120 and the auger-down relay 130 so that they operate also under the control of the control relay 110 and the operation switch 100.

The thermo-breaker 86 is a protection member incorporated in the electric motor 85 for protecting the electric motor from overheating. The thermo-breaker 86 is designed to cut off supply of electric current to the electric motor 85 when the electric motor 85 heats up to a given (overheat) temperature due to continued activation or frequent on-off operations of the operation switch 100.

When the left control lever 46A is in the neutral position Ne, or when the control relay 110 is in the off state (with the normally open contact 112 disposed in the original "off" or open position), the auger-up relay 120 and the auger-down relay 130 are both placed in the off condition. Under such condition, the electric motor 85 connected between the auger-up relay 120 and the auger-down relay 130 is in the off or de-energized state.

When the lift control lever 46A is pulled or tilted down toward the "Up" side to bring the movable contact 12 into contact with the first fixed contact 103 and, at the same time, the control switch 110 is in the on state (with the normally open contact 112 disposed in the "on" or activated position), the auger-up relay 120 is turned on or activated whereupon the electric motor 85 starts rotating in a forward direction.

Conversely, when the lift control lever 46A is pushed or tilted down toward the "Dw" side to bring the movable contact 12 into contact with the second fixed contact 104 and, at the same time, the control switch 110 is in the on state (with the normally open contact 112 disposed in the "on" or activated position), the auger-down relay 120 is turned on or activated whereupon the electric motor 85 starts rotating in a reverse direction.

Figure 7:
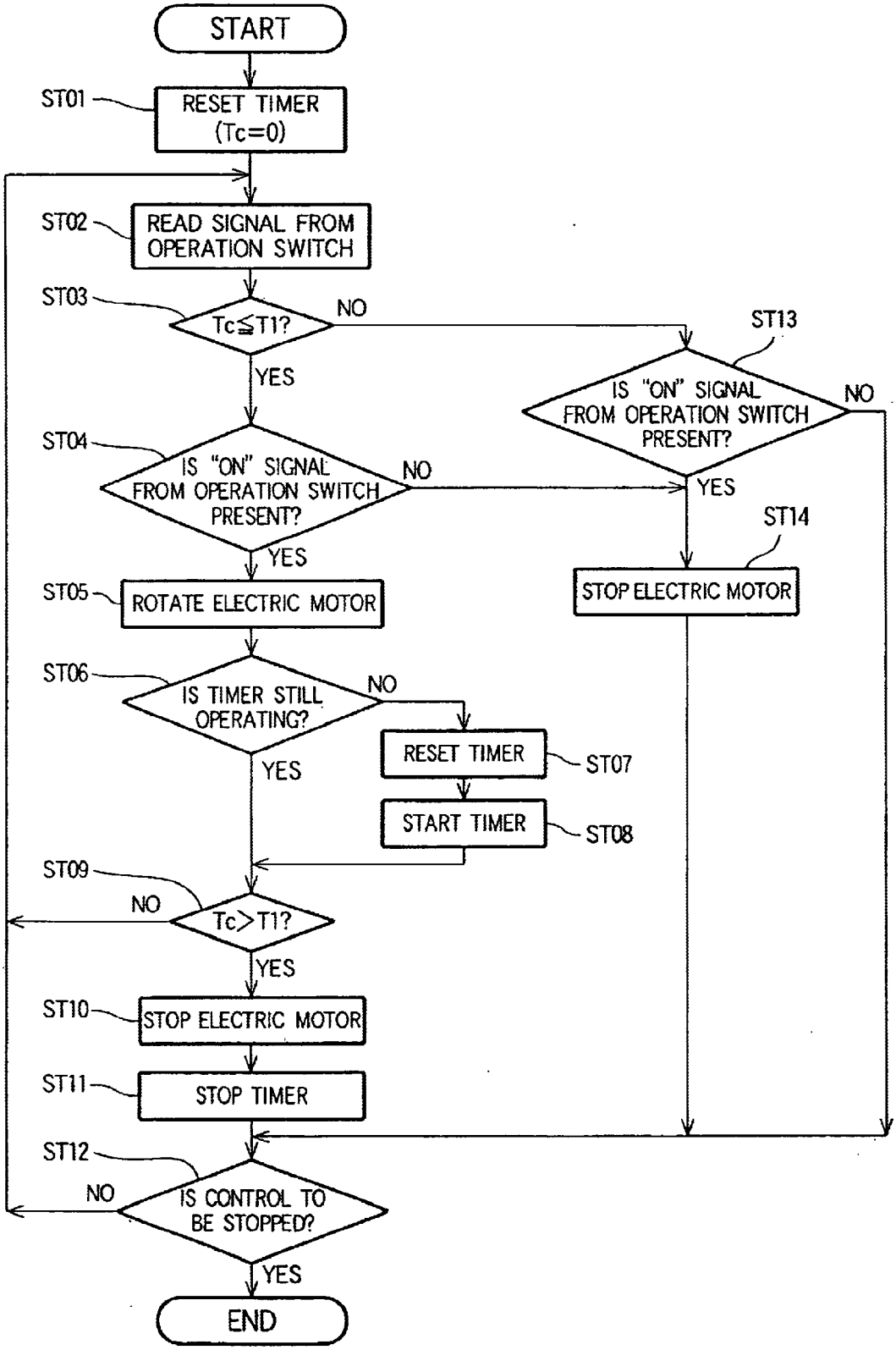
FIG. 7 is a flowchart showing a control procedure achieved by a control unit of the snowplow vehicle.

The control unit 28 shown in FIG. 6 is comprised of a microcomputer and can operate to achieve a control procedure as illustrated in the flowchart shown in FIG. 7. The control procedure achieved in the microcomputer (control unit) 28 will be described below in conjunction with the circuit diagram shown in FIG. 6.

The control procedure shown in FIG. 1 begins when the main switch 45B (FIG. 6) is turned on. At a first step ST01, a timer in a central processing unit of the microcomputer (control unit) 28 is reset to zero (Tc=0). Then ST02 reads a signal from the operation switch 100. Subsequently, ST03 judges whether or not the count in the timer has not exceeded the preset reference time T1. If the result of judgment is "YES" (Tc≦T1), this means that the preset reference time has not elapsed after activation of the operation switch 100. In this condition, the control procedure goes on to ST04. Alternatively, if the judgment result at ST03 is "NO" (Tc>T1), this means that the preset reference time T1 has passed after activation of the operation switch 100. Under such condition, the control procedure branches to ST13.

ST04, which follows ST03, makes a judgment to determine whether or not the "on" signal from the operation switch 100 is present. If, the result of judgment is "YES", this means that the lift control lever 46A has been tilted down toward the "Up" side or the "Dw" side. Under such condition, the control procedure advances to ST05, which turns on the control relay 110 to thereby rotate the electric motor 85. Alternatively, if the judgment result at ST04 is "NO", this means that the lift control lever 46A is in the neutral position "Ne". The control procedure then branches to ST14, which turns off the control relay 110 to thereby stop the electric motor 85.

ST05 is followed by ST06. At ST06, a judgment is made to determine whether or not the timer is still operating. If the result of judgment is "YES", the control procedure advances to ST09. Conversely, if the judgment result is "NO", the control procedure branches to ST07. At ST07, the timer is reset to zero (Tc=0). The timer is subsequently started at ST08. After ST08, the control procedure advances to ST09.

ST09 judges whether or not the count in the timer Tc has exceed the preset reference time T1 (Tc>T1). If the result of judgment is "YES", this means that the preset reference time T1 has elapsed after activation of the operation switch 100. Under such condition, the control goes on to ST10 and turns off the control relay 100 to thereby forcibly stop the electric motor 85. Alternatively, if the judgment result at ST09 is "NO", this means that the preset reference time T1 has not elapsed after activation of the operation switch 100. The control procedure then returns to ST02.

ST10 is followed by ST11 where the timer in the control unit 28 is stopped. Subsequently, the control procedure advances to ST12, which makes a judgment to determine whether or not the control procedure is to be terminated. If the result of judgment is "YES", the control procedure is stopped. Alternatively, if the judgment result is "NO", the control procedure returns to ST02.

At ST13, which is branched off from ST03, a judgment is made to determine whether or not the "on" signal from the operation switch 100 is present. If the result of judgment is "YES", this means that the lift control lever 46A is still tilted down toward the "Up" side or the "Dw" side even after the lapse of the preset reference time T1. Under such condition, the control procedure goes on to ST14 where the control relay 110 is turned off or deactivated to thereby stop the electric motor 85. ST14 is followed by ST12 described previously. Alternatively, if the judgment result at ST13 is "NO", this means that the lift control lever 46A is in the neutral position Ne after the lapse of the preset reference time T1. The control procedure then jumps to ST12 where, as previously described, judgment is made to determine whether or not the control procedure is to be terminated.

It will be appreciated from the foregoing description that when the operation switch 100 (FIG. 6) is turned on or activated to rotate the electric motor 85 in the forward or the reverse direction, the electro-hydraulic cylinder actuator frame lift mechanism) 16 generates a fluid pressure to extend or contract the piston rod 82. By virtue of the extending or contracting movement of the piston rod 82, the front end portion of the vehicle frame 15 and the auger 31 mounted thereto are lifted up and down, as illustrated in FIGS. 5A and 5B.

When the preset reference time T1 has elapsed after activation of the operation switch 100 (T1 being equal to an operating time of the electro-hydraulic cylinder actuator 16 which is required to move the piston rod 82 over a maximum stroke defined between the fully extended position and the fully contracted position of the piston rod 82), the control unit 28 forcibly stops the electric motor 85 even if the operation switch 100 in the "on" or activated state. By thus forcibly stopping the electric motor 85, it is possible to cut down the operating time of the electric motor. Since the electric motor 85 is released from a heavily loaded condition soon after the arrival of the piston rod 82 at its fully extended or contracted position, the load on the frame lift mechanism 16 including the electric motor 85 is lessened and the durability of the frame lift mechanism 16 is increased.

Additionally, since the electric motor 85 is stopped when the piston rod 82 moves over the maximum stroke, generation of heat from the electric motor 85 can be suppressed The thermo-breaker 85 built in the electric motor 86 does not operate, so that the operator is allowed to continue snow-removing operation of the snowplow vehicle 10 without considering a downtime of the snowplow vehicle 10 which may occur when the thermo-breaker 86 operates. The snow-removing operation can, therefore, be achieved smoothly and efficiently.

Furthermore, the electro-hydraulic cylinder actuator (frame lift mechanism) 16 can operate smoothly and reliably without requiring detection switches provided for detecting the piston rod 82 arrived at the fully extended position and the fully contracted position. The snowplow vehicle 10 is, therefore, formed by a reduced number of parts used and has a relatively simple electric wiring system. This achieves cost cutting of the snowplow vehicle 10.

Additionally, when the operation switch 100 is still in the activated state even after the electric motor 85 is forcibly stopped upon the lapse of the preset reference time T1 (which is equal to an operating time required for the electro-hydraulic cylinder actuator 16 to move the piston rod 82 over the maximum stroke), the control unit 28 continues to stop the electric motor 85. Thus, a heavily loaded condition of the electric motor 85 does not recur with the result that the total load exerted on the frame lift mechanism 16 including the electric motor 85 is reduced and the durability of the frame lift mechanism 16 is increased. Additionally, since the thermo-breaker 86 is kept in the off or inactivated state, a downtime does not occur. Thus, the snow-removing operation can be continued smoothly and efficiently.

When the stroke of the piston rod 82 is changed due to the influence of snow, dirt, mud and other foreign matter, the control unit 28 forcibly stops the electric motor 85 upon the lapse of the predetermined reference time T1 regardless of the operation switch 100 being in the on or activated state. As a result, a heavily loaded condition of the electric motor 85 is immediately removed. This ensures that the total load applied to the frame lift mechanism 16 including the electric motor 85 is reduced and the durability of the frame lift mechanism 16 is increased. Additionally, by virtue of the forcible stop of the electric motor 85, generation of heat from the electric motor 85 can be suppressed. The thermo-breaker 85 built in the electric motor 65 does not operate.

The control unit 28 shown in FIG. 6 may be modified to have a function of integrating or adding up the running time Trα of the electric motor 85 during which the electric motor 85 is rotating and forcibly stopping the electric motor 85 when the integrated value (total sum of the running times) Tm reaches a predetermined reference value (reference time) T2. The predetermined reference value T2 corresponds to a time which is required for the electric motor 85 to heat up above a predetermined temperature. For instance, if the cumulative running time and cumulative rest time of the electric motor are represented by Tr and Ts, respectively, the integrated value (total sum) Tm of the running times is obtained by Tm=Tr−Ts.

The modified control unit, designated by 28*a* in FIG. 6 for purposes of explanation, further has a function of continuing stopping of the electric motor 85 until a predetermined fixed time (reference time) T3 has passed.

More specifically, the modified control unit 28*a* performs various control operations, as enumerated below (1) When the main switch 45B (FIG. 6) is turned on or activated, the control relay 110 is turned on or activated.

(2) Time periods during which the "on" state signal from the operation switch 100 is present (i.e., running times Trα of the electric motor 85 during which the electric motor 85 is rotating) are integrated or added up, and when an integrated value (total sum) Tm of the running times Trα reaches the reference value T2, the control relay 100 is forcibly turned off or deactivated.

(3) After forcible de-activation of the control relay 110, the "off" or deactivated state of the control relay 110 is continuously maintained until the reference time T3 has passed.

(4) When the control relay 110 is in the "on" state, this means that the electric motor 85 is running or rotating. Under such condition, the control lamp 141 is kept in the on or activated state.

Stated in more concretely, the cumulative running time Tr is updated each time a predetermined time has passed. That is, each time the predetermined time has passed, a running time Trα is added to the accumulated total Tr of the running times during the preceding interval (Tm=Tr+Trα). The running time Trα has a predetermined value such as 11 milliseconds (ms), which is added up, at an interval of 100 milliseconds (ms).

On the other hand, the cumulative rest time Ts is updated each time a predetermined time has passed. That is, each time the predetermined time has passed, a rest time Trβ during which the electric motor 85 is stopping or not rotating is added to the accumulated total Ts of the rest times during the preceding interval (Ts=Ts+Trβ). The rest time Trβ has a predetermined value such as 10 ms, which is added up, at an interval of 100 ms.

The thus obtained cumulative rest time Ts is subtracted from the cumulative running time Tr to thereby obtain an integrated value or total sum Tm of the rotating times (Tm=Tr−Ts).

The running time Trα (i.e., 11 ms) which is added up at intervals of 100 ms is set to be larger than the rest time (i.e., 10 ms) which is also added up at intervals of 100 ms, the reason for which is as follows.

In general, a heat-developing time, which is required for the electric motor 85 to heat up from the room temperature to a predetermined elevated temperature while it is rotating, is shorter than a heat-releasing time which is required for the electric motor 85 to cool down from the elevated temperature to the room temperature while it is at a standstill. If the running time Trα is set to be equal to the rest time Trβ, it may occur that the integrated value or total sum Tm of the running times becomes zero even though the electric motor 85 has not cooled down to the room temperature. To preclude the occurrence of this problem, the running time Trα added up at intervals of 100 ms is set to be longer than the rest time Trβ added up at intervals of 100 ms.

Figure 8:
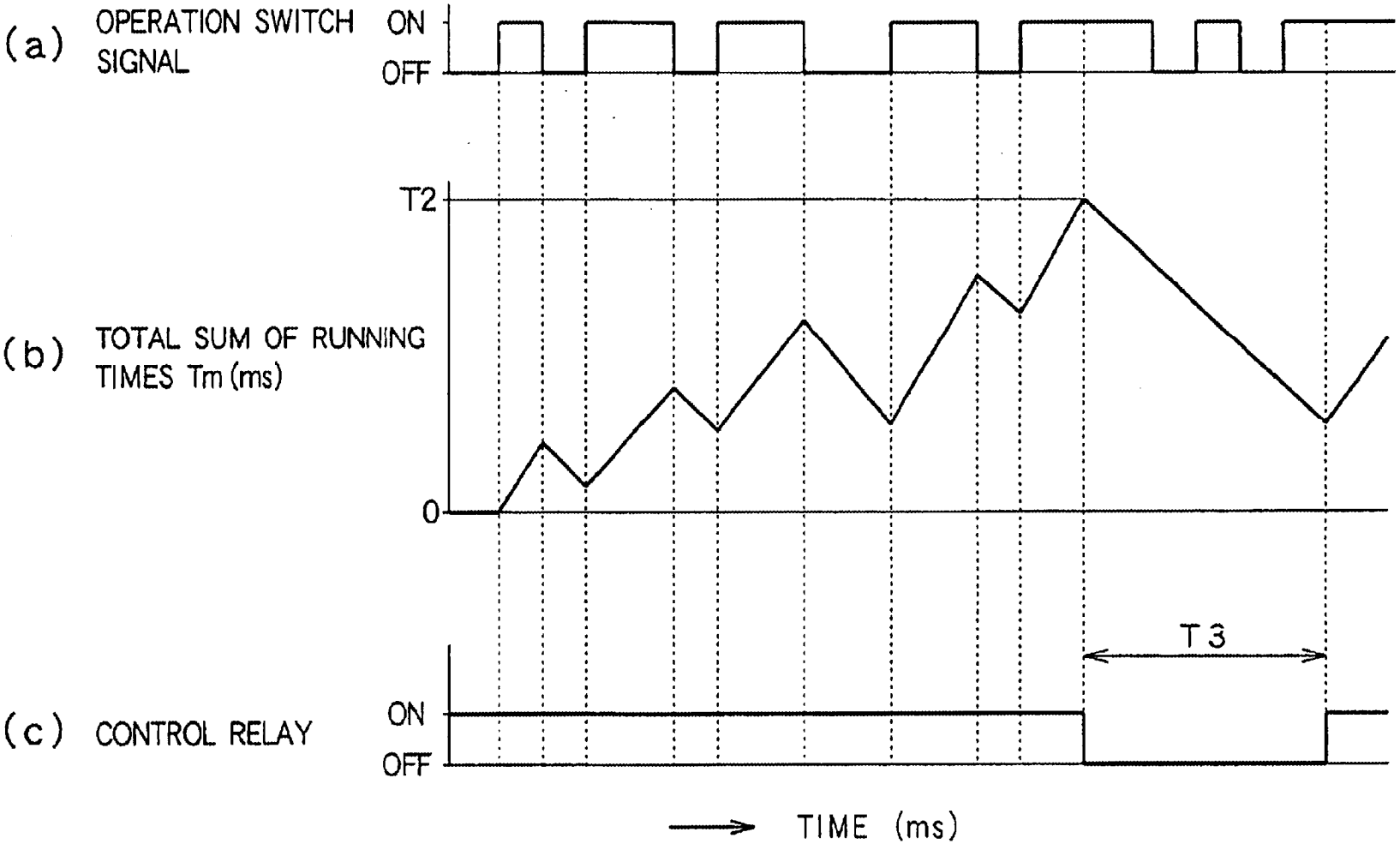
FIG. 8 is a time chart explanatory of the operation of the control unit.

FIG. 8 is a timing chart illustrative of operation of the modified control unit 28*a* (FIG. 6). In FIG. 8(*a*), the horizontal axis represents time (ms), and the vertical axis represents the state of the operation switch 100 (FIG. 6). In FIG. 8(*b*), the horizontal axis represents time (ms), and the vertical axis represents an integrated value or total sum Tm (ms) of running times of the electric motor 85. Similarly, in FIG. 8(*c*), horizontal axis represents time (ms), and the vertical axis represents the state of the control relay 110 (FIG. 6).

As shown in FIG. 8(*b*), the integrated value or total sum Tm of running times of the electric motor 85 increases gradually as long as a signal indicative of the "on" or activated state of the operation switch 100 is present (namely, when the electric motor 85 is rotating). Alternatively, when the "off" or deactivated state of the operation switch 100 is present (namely, when the electric motor 85 is at rest), the integrated value or total sum Tm of running times of the electric motor 85 decreases gradually. When the total sum Tm of running times reaches the reference value T2, the control relay 110 is forcibly changed or shifted from the "on" or activated state to the "off" or de-activated state.

As shown in FIG. 8(*c*), after forcible stopping of the control relay 110, the "off" or deactivated state of the control relay 110 is maintained until the reference time T3 has passed. During that time, the electric motor 85 continues to stop even when the "on" state signal is received from the operation switch 100. Thus, the total sum Tm of running times gradually decreases until the reference time T3 has passed.

Figure 9:
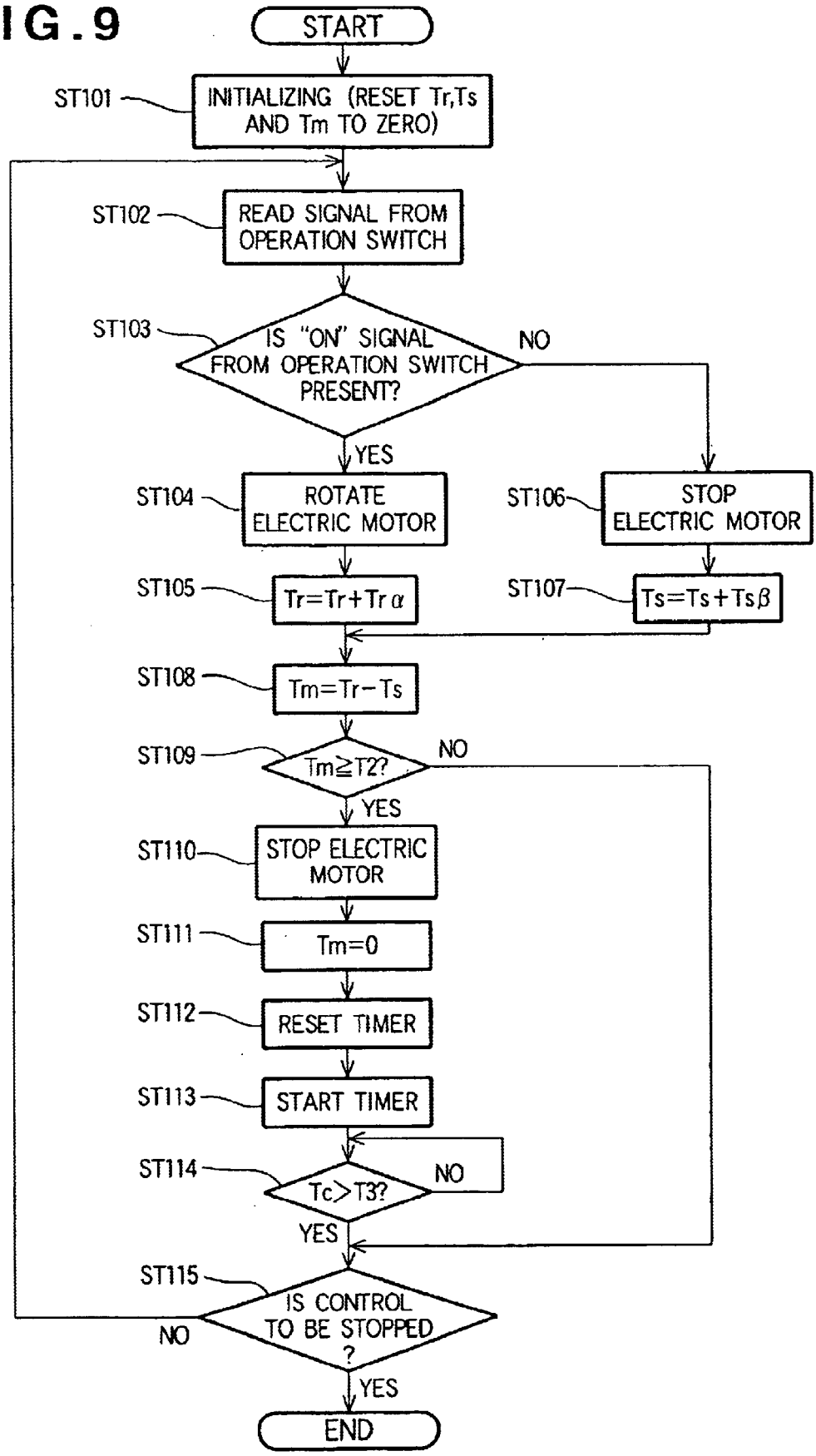
FIG. 9 is a flowchart showing a modified control procedure achieved by the control unit.

FIG. 9 is a flowchart showing a control procedure achieved by the CPU incorporated in the modified control unit 28*a* shown in FIG. 6.

At a first step ST101, all the values are initialized. Namely, the cumulative running time Tr, cumulative rest time Ts and the integrated value or total sum Tm of running times are all reset to zero. Then, a signal from the operation switch 100 is read in at ST102 and, subsequently, ST103 judges whether or not the signal from the operating switch 100 is in the "on" or activated state. If the result of judgment is "YES", this means that the lift control lever 46A (FIG. 6) has been tilted down toward the "Up" side or the "Dw" side. Under such condition, the control procedure advances to ST104 where the control relay 110 is turned on or activated to thereby rotate the electric motor 85. Alternatively, if the judgment result at ST103 is "NO", this means that the lift control lever 46A is in the neutral position "Ne". The control procedure then branches to ST106 where the control relay 110 is turned off or deactivated to thereby stop the electric motor 85.

ST104 is followed by ST105 where a cumulative running time Tr is determined by adding a running time Trα of the electric motor 85 to the accumulated total Tr of running times during the preceding interval (Tr=Tr+Trα). ST106 is followed by ST107 where a cumulative rest time Ts is determined by adding a rest time Tsβ of the electric motor 85 is added to the accumulated total Ts of rest times during the preceding interval (Ts=Ts+Tsβ). The thus determined cumulative rest time Ts is subtracted from the cumulative running time Tr so that an integrated value or total sum Tm of running times (Tm=Tr−Ts) is obtained at ST108.

Subsequently, ST109 judges whether or not the total sum Tm of running times has reached the predetermined value T2 (Tm≧T2). If the result of judgment is "YES", the control procedure goes on to ST110 where the control relay 110 is forcibly turned off to thereby stop rotation of the electric motor 85. Alternatively, if the judgment result at ST109 is "NO", the control procedure branches to ST115.

ST110 is followed by ST111 where the total sum Tm of running times is reset to zero (Tm=0). The control procedure goes on to ST112 where the internal timer of the control unit 28 is reset to zero (Tc=0). The internal timer is started again at ST113, and at the next following step ST114 a judgment is made to determine whether or not a count TC of the timer has exceeded the reference time T3 (Tc>T3). If the result of judgment is "YES", the control procedure goes on to ST115 Alternatively, if the judgment result at ST114 is "NO", ST114 will repeat the same judgment process until Tc exceeds T3.

At ST115, a judgment is made to determine whether or not the control procedure is to be stopped. If the result of judgment is "ES" (for instance, when the main switch 45B has been turned off), the control procedure is terminated. Alternatively, if the result of judgment at ST115 is "NO", the control procedure returns to ST102.

It will be appreciated from the foregoing description that in the modified arrangement shown in FIGS. 5, 6, 8 and 9, when the operation switch 100 (FIG. 6) is turned on or activated to rotate the electric motor 85 in the forward or the reverse direction, a hydraulic pressure is produced, and by the hydraulic pressure, the piston rod 82 of the electro-hydraulic cylinder actuator (frame lift mechanism) 16 is extended or contracted. By thus extending or contracting the piston rod 82, the front end portion of the vehicle frame 15 and the auger 31 mounted thereto are lifted up and down, as illustrated in FIGS. 5A and 5B.

While the electric motor 85 is rotating, the running time Trα of the electric motor 85 is added up at uniform intervals of time, and when an integral value or total sum Tm of the running times reaches the predetermined reference time T2, the electric motor 85 is forcibly stopped by the control unit 28*a* regardless of the operation switch 100 being in the "on" or activated state. By thus forcibly stopping the electric motor 85, the motor 85 is protected from overloading and thus has a higher degree of durability.

Additionally, the electric motor 85 is stopped rapidly without operating the thermo-breaker 86 built in the electric motor 85. The control of the electric motor 85 depends on time and does not rely on the thermo-breaker 86 which requires a relatively long time to recover its original in operating state. It is, therefore, possible to resume rotation of the electric motor 85 in a relatively short period of time. Since snow-removing operation of the snowplow vehicle 10 can be continued without considering a downtime, which may occur when the thermo-breaker 86 operates, the efficiency of the snow-removing operation is very high.

In the arrangement using the control unit 28*a* shown in FIG. 6, the cumulative running time Tr and the cumulative rest time Ts of the electric motor 85 are represented by Tr and Ts, respectively, so that we can obtain an integrated value or total sum Tm of the running times of the motor 85 from the expression Tm=Tr−Ts.

It may be considered that the cumulative running time Tr is a total sum of the running times of the motor during which the electric motor 85 heats up while it is rotating, and the cumulative rest time Ts is a total sum of the rest times of the motor 85 during which the electric motor 85 cools down while it is at a standstill. By using the integrated value or total sum Tm of rotating times which is represented by the expression Tm=Tr−Ts, control of the electric motor 85 is achieved in dose match with actual heat-developing and -releasing conditions of the electric motor 85. Since the cumulative rest time (heat-releasing time) Ts of the electric motor 85 is subtracted from the cumulative running time (heat-developing time) Tr, it is possible to elongate the time during which the integrated value or total sum Tm of running times reaches the preset reference value T2. This means that the time period during which the motor 85 continues to rotate before it is forcibly stopped can be extended The snow-removing operation of the snowplow vehicle can be achieved with improved efficiency.

Furthermore, after forcible stop of the electric motor 85, the control unit 28*a* continues to stop the electric motor 85 until the preset reference time T3 has passed. During that time, heat developed in the electric motor 85 is released. The electric motor 85 is thus prevented from overheating and hence has an improved degree of durability.

Figure 10:
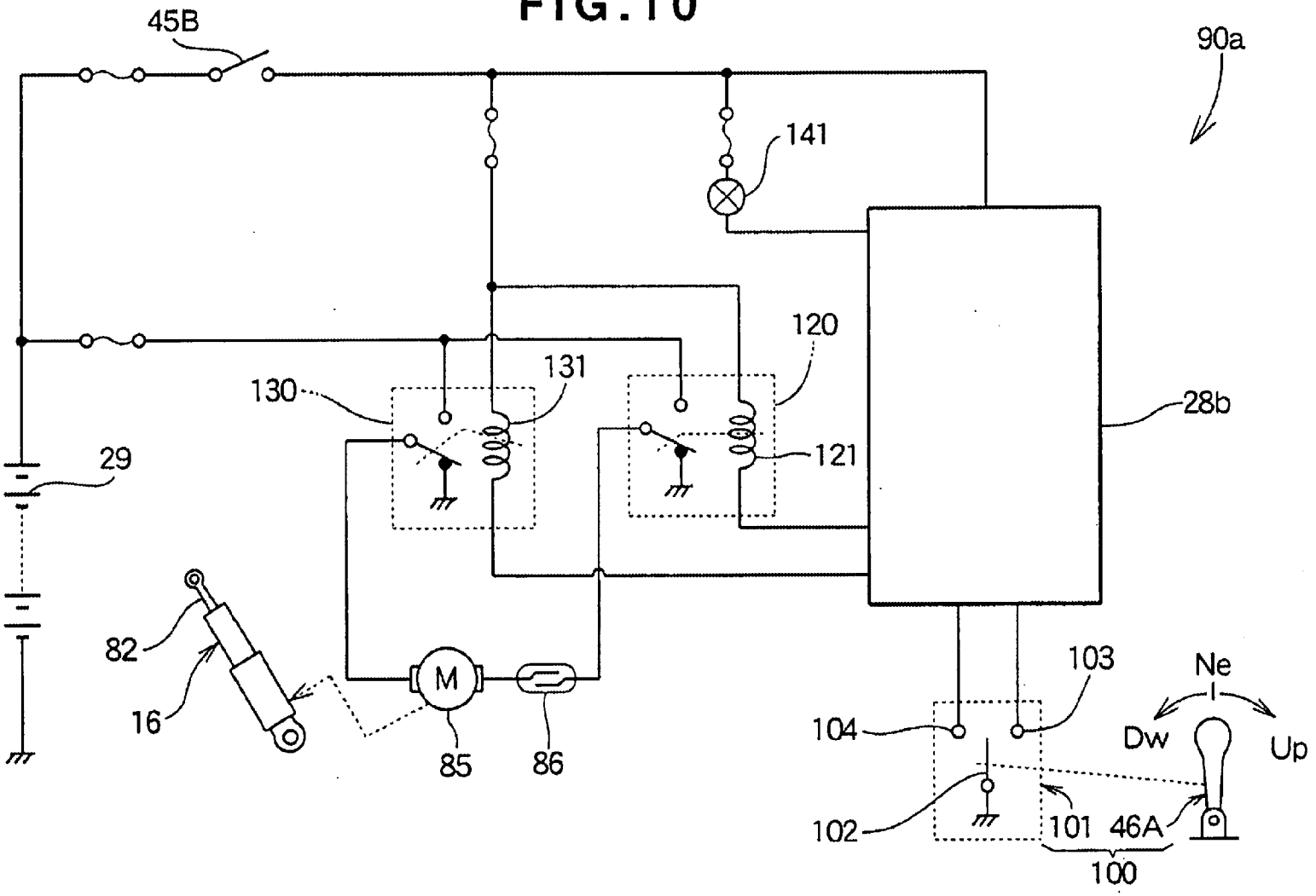
FIG. 10 is a circuit diagram showing the control unit and related parts thereof according to a modification of the present invention.

FIG. 10 is a circuit diagram showing a control unit 28*b* and related parts thereof according to a further modification of the present invention;

The electric circuit 90A shown in FIG. 10 differs from the electric circuit 90 shown in FIG. 6 only in that the control relay 110 is omitted, and the control unit 28*b* performs on-off control of the auger-up relay 120 and auger-down relay 130 by directly energizing or de-energizing the excitation coils 121, 131 of the relays 120, 130. These parts which are identical to those shown in FIG. 6 are designated by the same reference characters, and a further description thereof can be omitted.

The control unit 28*b* is designed to perform various control operations as enumerated below.

(1) When the "on" state signal from operation switch 100 is not present, the auger-up relay 120 and the auger-down relay 130 are kept in the off or deactivated state.

(2) When the lift control lever 46A is tilted down toward the "Up" side, an "on" state signal from the operation switch 100 is received whereupon the auger-up relay 120 is turned on or activated.

(3) When the lift control lever 46A is tilted down toward the "Dw" side, an "on" state signal from the operation switch 100 is received whereupon the auger-down relay 130 is turned on or activated.

(4) As to the function of controlling the auger-up relay 120 and the auger-down relay 130, which is achieved through the control relay 110 in the case of the control unit 28, 28*a* shown in FIG. 6 and described above with reference to FIGS. 7 and 9, the control unit 28*b* has substantially the same function even though the relays 120, 130 are directly controlled by the control unit 28*b*.

(5) when the control relay 110 is in the "on" state, this means that the electric motor 85 is running or rotating. Under such condition, the control lamp 141 is kept in the on or activated state.

The control procedure shown in the flowchart of FIG. 7 and the control procedure shown in the flowchart of FIG. 9 may be combined to attain the advantageous effects achieved by the two control procedures. The control procedures thus combined can be achieved by appropriately modifying the control unit 28, 28*a* or 28*b*.

Figure 11:
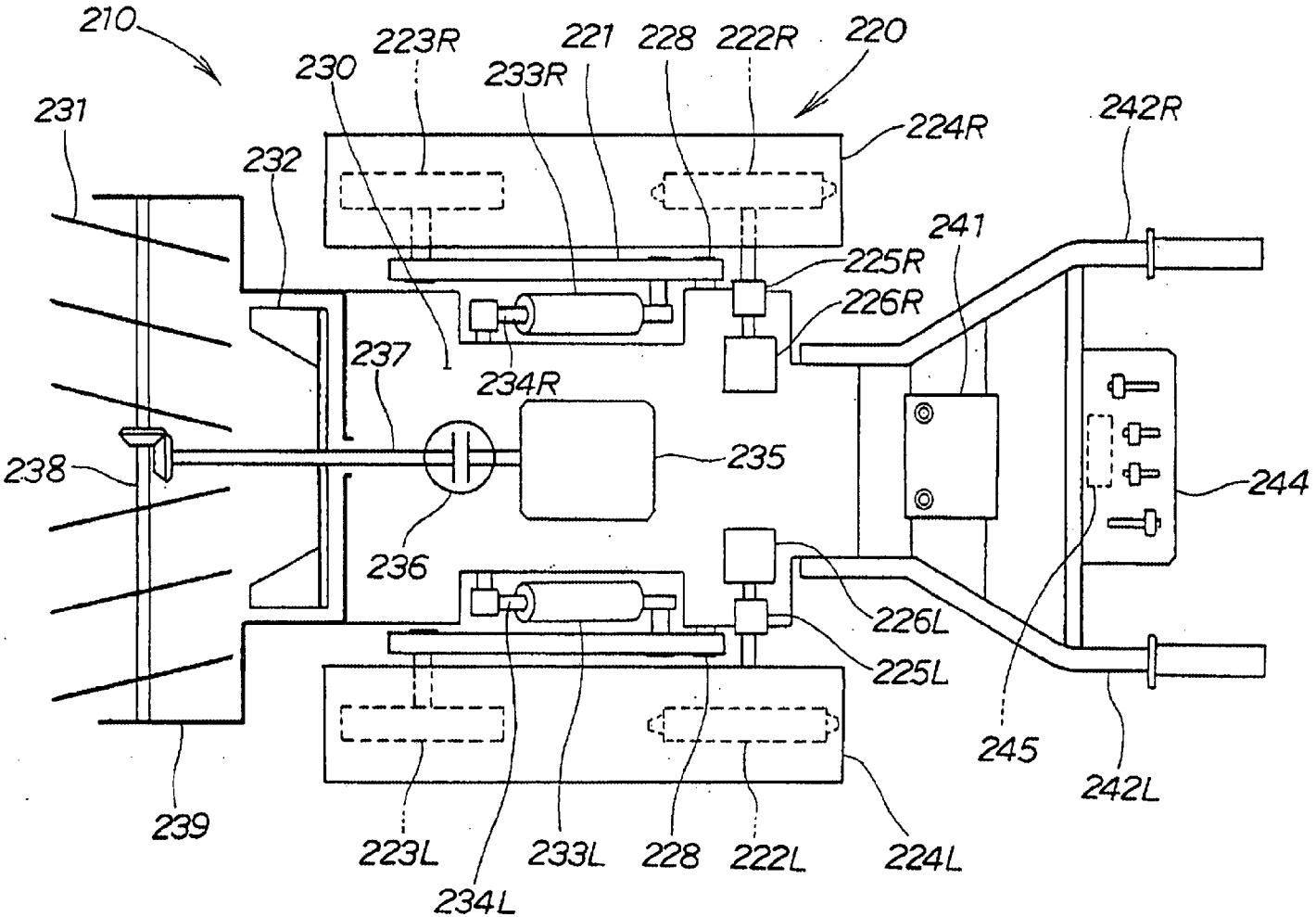
FIG. 11 is a diagrammatic plan view of a walk behind self-propelled crawler snowplow according to another embodiment of the present invention.

FIG. 11 schematically shows in plan view a walk behind self-propelled crawler snowplow vehicle according to another embodiment of the present invention.

The snowplow vehicle 210 includes a propelling body 220 having a propelling frame 221, and a vehicle frame 230 pivotally connected at 228, 228 to the propelling frame 221. A snow removing unit or mechanism including an auger 231 and a blower 232 is mounted on a front end portion of the vehicle frame 230.

The propelling body 220 further has a pair of left and right driving wheels 222L, 222R and a pair of left and right driven wheels 223L, 223R mounted to the propelling frame 221. A pair of left and right crawler belts 224L, 224R is entrained around a pair of driving and driven wheels 222L and 223L or 222R and 223R on either side of the propelling frame 221. Each of the driving wheels 222L, 222R is connected to an electric motor 226L, 226R via a speed reducer 225L, 225R. The vehicle frame 230 carries thereon an engine 235, an auger clutch 236 and a rotating shaft 237 connected in driven relation to the engine 235 via the auger clutch 236. The rotating shaft 237 is connected in driving relation to an auger shaft 238 of the auger 231. The auger 231 and the blower 232 are housed in an auger housing 239 mounted on the front end portion of the vehicle frame 230.

Left and right lift cylinder actuator 233L, 233R are disposed on opposite outer sides of the vehicle frame 230 and connected between the vehicle frame 230 and the propelling frame 221 such that in response to extending and contracting movements of respective piston rods 234L, 234R of the cylinder actuators 233L, 233R, the front end portion of the vehicle frame 230 and the auger 231 are lifted up and down relative to the propelling frame 221

Preferably, the lift cylinder actuators 233L, 233R comprise an electric linear actuator or an electro-hydraulic cylinder actuator that can perform extending and contracting motions at the same speed. The electric linear actuator comprises an electric motor as a power source, and a ball-screw mechanism composed of a screw rotatably driven by the electric motor within a cylinder and a nut threaded with the screw and connected at one end of an actuator rod slidably received in the cylinder. When the electric motor is driven to rotate the screw in one direction, rotary motion of the screw is converted by the nut into an extending or contracting movement of the actuator rod relative to the cylinder. The motor is designed to rotate in the forward and reverse directions at the same speed, so that the actuator rod can perform extending and contracting motions at the same speed. The electro-hydraulic cylinder actuator is formed by a combination of a hydraulic cylinder actuator and a motor-driven hydraulic pump. The pump is driven by an electric motor to produce a fluid pressure used for reciprocating a piston rod of the cylinder actuator. The electro-hydraulic cylinder actuator is designed such that an extending motion and a contacting motion occur at the same speed. In the illustrated embodiment, the lift cylinder actuators 233L, 233R are of the electro-hydraulic type including an electric motor for driving a hydraulic pump to produce a fluid pressure for reciprocating the piston rod 234L, 234R of the cylinder actuator. The electric motor and the hydraulic pump are not shown in FIG. 11 but they are assembled with a cylinder of each cylinder actuator 233L, 233R in the same manner as described above with respect to the embodiment shown in FIGS. 1–10.

In FIG. 11, reference character 41 denotes a battery for supplying electric power to the electric motors 226L, 226R. Reference characters 42L, 42R denote left and right handlebars extending from a rear portion of the vehicle frame 230 obliquely upward in a rearward direction of the snowplow vehicle 210. Reference numeral 244 denotes a control board, and reference numeral 245 denotes a control unit disposed in the control board 244. The snowplow vehicle may be a wheeled vehicle having front and rear wheels wearing tires, or a half-crawler vehicle having front wheels wearing tires and intermediate and rear wheels connected by a crawler belt. The snow removing mechanism may include a dozer blade.

Figure 12A:
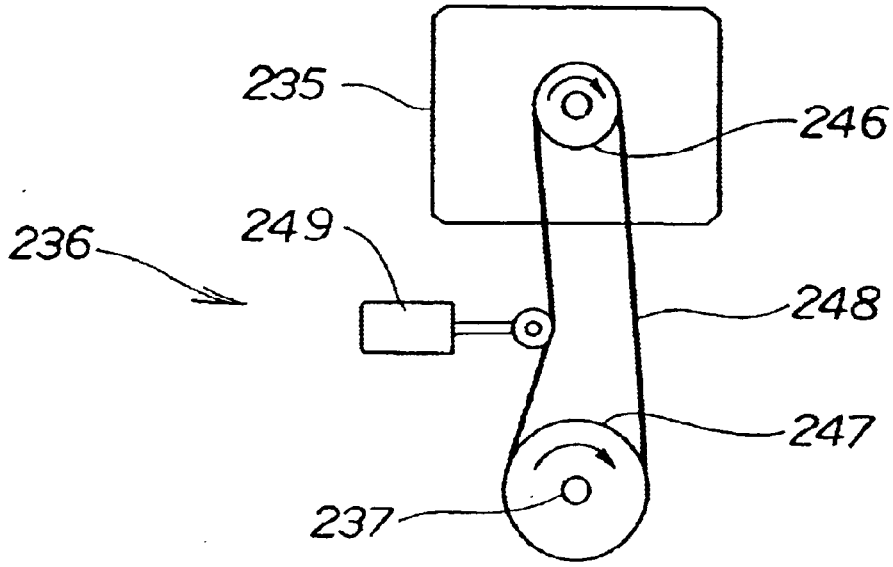
FIGS. 12A and 12B are diagrammatical views illustrative of the operation of an auger clutch equipped in the snowplow vehicle shown in FIG. 11.
Figure 12B:
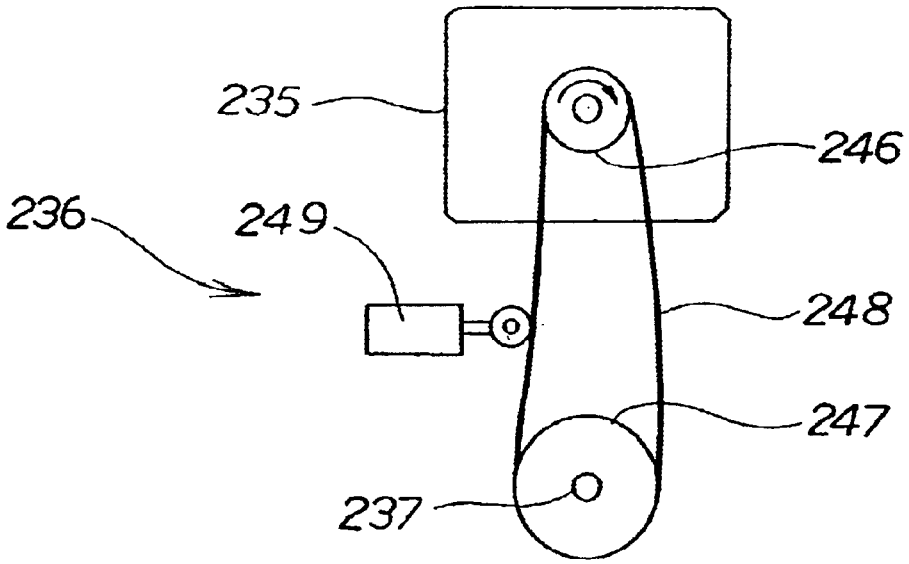

FIGS. 12A and 12B are diagrammatical views illustrative of the arrangement and operation of the auger clutch 236. The auger clutch 236 comprises a first or driving pulley 246 firmly connected to an output shaft (not designated) of the engine 235, a second or driven pulley 247 firmly connected to the rotating shaft 237, an endless belt 248 entrained around the driving and driven pulleys 246, 247, and a clutch actuator 249 disposed on one side of the belt 248 for applying a tension to the belt 248. The clutch actuator 249 is preferably comprised of a solenoid-operated plunger.

As shown in FIG. 12A, when the clutch actuator 249 operates to tension the belt 248, rotational motion of the driving pulley 246 is transmitted via the belt 248 to the driven pulley 247, thereby rotating the rotating shaft 237 The auger 231 and the blower 232 that are coupled to the rotating shaft 237 are thus rotated The auger clutch 236 shown in FIG. 12A is in the ON or engaged state.

When the clutch actuator 249 is disposed in its original inoperating position shown in FIG. 12B, the belt 248 is in a free or loose state and hence has no function of transmitting rotational motion of the driving pulley 246 to the driven pulley 247. Since the driven pulley 247 is thus isolated from rotation of the driving pulley 246, the rotating shaft 237 does not rotate. The auger 231 and the blower 232 that are coupled to the rotating shaft 237 do not rotate. The auger clutch 236 shown in FIG. 12B is in the OFF or disengaged state.

Figure 13:
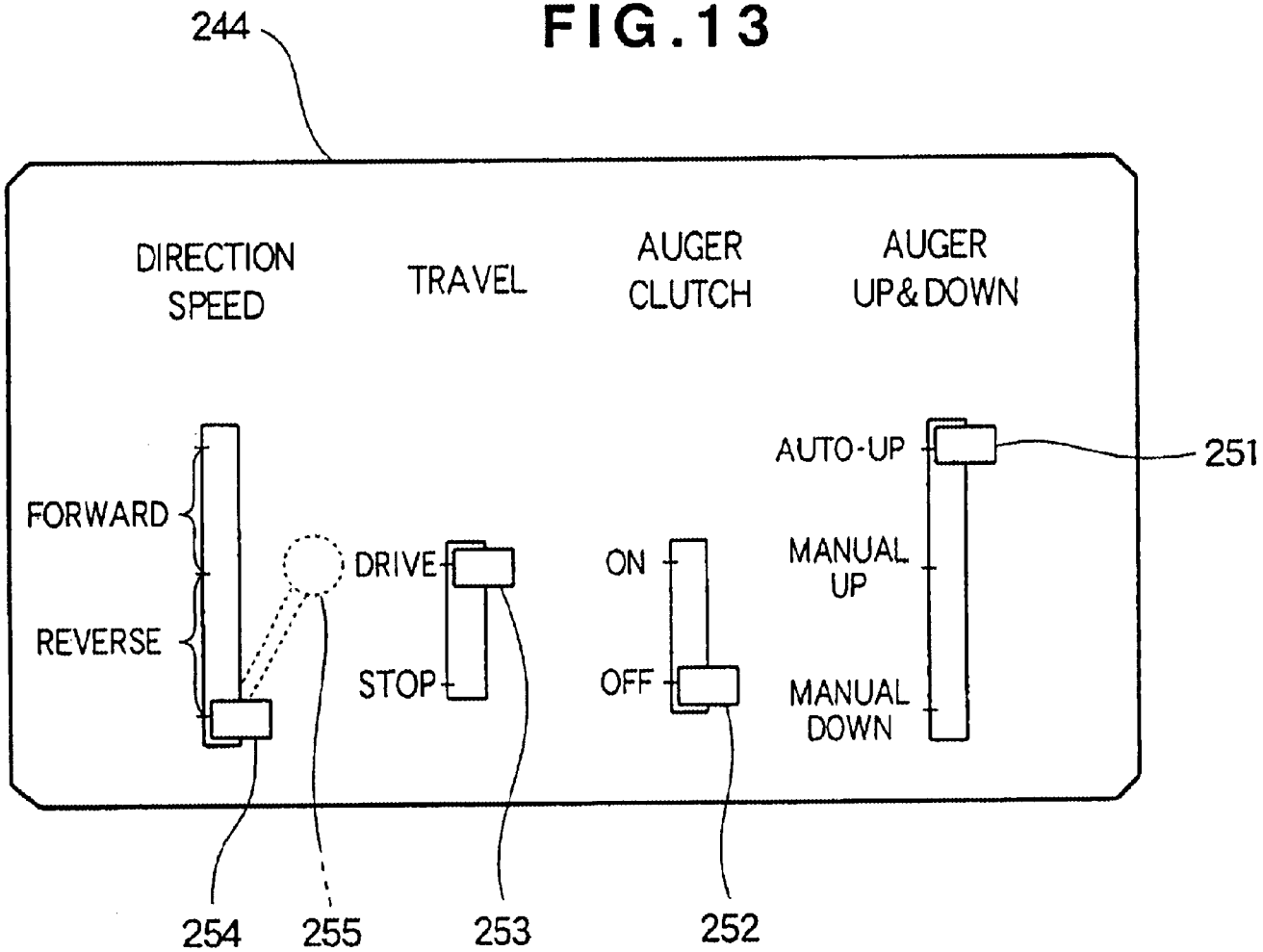
FIG. 13 is an enlarged plan view of a control board.

FIG. 13 is a top plan view of the control board 244 of the snowplow vehicle 210 shown in FIG. 11. As shown in FIG. 13, the control board 244 is equipped with an auger lift control lever (hereinafter referred to, for brevity, as "lift control lever") 251 for raising or lowering the auger 231 (FIG. 11) by extending or contracting the lift cylinder actuators 233L, 233R (FIG. 11), an auger clutch lever 252 for engaging or disengaging the auger clutch 236 by activating or deactivating the clutch actuator 249 (FIGS. 12A and 12B), a travel control lever 253 for making or breaking a power line from the batteries 241 to the electric motors 226L, 226R to allow or prevent rotation of the electric motors 226L, 226R, and a direction/speed control lever 255 for controlling the direction and speed of rotation of the electric motors 226L, 226R.

The lift control lever 251 is movable between a first position (auto-up position) in which an auto-up mode is selected, a second position (manual-up position) in which a manual-up mode is selected, and a third position (manual-down position) in which a manual-down mode is selected. The direction/speed control lever 254 is operatively connected with a potentiometer (variable resistor) 255 that produces a voltage signal continuously variable within a range corresponding to a range of movement of the direction/speed control lever 254 defined between a forward high speed position and a forward low speed position, and a voltage signal continuously variable within a range corresponding to a range of movement of the direction/speed control lever 254 defined between a reverse high speed position and a reverse low speed position. Based on the variable voltage signals from the potentiometer 255, the direction and speed of travel of the snowplow vehicle 210 (FIG. 11).

A control procedure achieved by the control unit 245 will be described below with reference to the flowchart shown in FIG. 14.

The control procedure begins at ST201 where a judgment is made to determine the current position of the lift control lever 251. When the lift control lever 251 is disposed in the manual-up position and, hence, the manual-up mode of operation is selected, the control procedure advances to ST202 where the lift cylinder actuators 233L, 233R are extended with the result that the auger 231 is raised to an elevated position.

When the result of judgment at ST201 indicates that the lift control lever 251 is disposed in the manual-down position and, hence, the manual-down mode of operation is selected, the control procedure branches to ST204 where the lift cylinder actuators 233L, 233R are contracted. ST204 is followed by ST205 where the measurement of operating time of the lift cylinder actuators 233L, 233R is started by using a clock friction of the control unit 245. Stated more specifically, a motor current flowing through the electric motor of one lift cylinder actuator 233L or 233R is monitored, and when the motor current exceeds a predetermined value, the internal clock of the control unit 245 starts to measure time (operating time of the lift cylinder actuators 233L, 233R). As a result of contracting movement of the lift cylinder actuators 233L, 233R, the auger 231 is moved downward at ST206. When the lift control lever 251 is shifted from the manual-down position to the auto-up position or the manual-up position, downward movement of the auger 231 is stopped. At this time, ST207 determines an operating time Td of the lift cylinder actuators 233L, 233R, which starts when the motor current exceeds the predetermined value and is ended when the auto-up position or the manual-up position is selected by the lift control lever 251. The operating time Td thus determined is stored in the control unit 245 at ST208. The stored operating time Td is updated each time a shift from the manual-down mode to another operation mode occurs.

When the result of judgment at ST201 indicates that the lift control lever 251 is disposed in the auto-up position and, hence, the auto-up operation mode is selected, the control procedure branches to ST209 where a judgment is made to determine whether or not the direction/speed control lever 254 is disposed in the reverse position. If the result of judgment is "NO", the control procedure goes to an end. Alternatively, if the judgment result is "YES", the control procedure advances to ST210 where the lift cylinder actuators 233L, 233R are extended for a time which is equal the operating time Td stored in the control unit 245. By thus extending the lift cylinder actuators 233L, 233R, the auger 231 is raised to an elevated position at ST211. It is important to note that the amount of upward movement of the auger 231 (corresponding to the amount of extension of the lift cylinder actuators 233L, 233R) achieved by ST210 to ST211 in the auto-up operation mode is set to be equal to the amount of downward movement of the auger 231 (corresponding to the amount of contraction of the lift cylinder actuators 233L, 233R) achieved by ST204 to ST207 in the manual-down operation mode.

The travel condition of the snowplow vehicle 210, which may occur immediately before the manual-down mode is selected, is considered to be a road traveling condition in which the snowplow vehicle travels on a road surface with the auger 231 held in an uppermost position, or a reversing condition in which the snowplow vehicle travels backwards on a snow-covered road surface with the auger 231 held in an elevated position intermediate between the uppermost inclined position and a lowermost horizontal position. The auger 231, as it is in the elevated intermediate position, does not interfere with snow while the snowplow vehicle 210 is reversing. From this, according to the present invention, when the auto-up mode is selected, the auger 231 is raised to the elevated intermediate position. The auger 231 is thus automatically returned to the previous position, so that there is no possibility of interference occurring between the auger 231 and snow when the snowplow vehicle is moving backwards.

Figure 14:
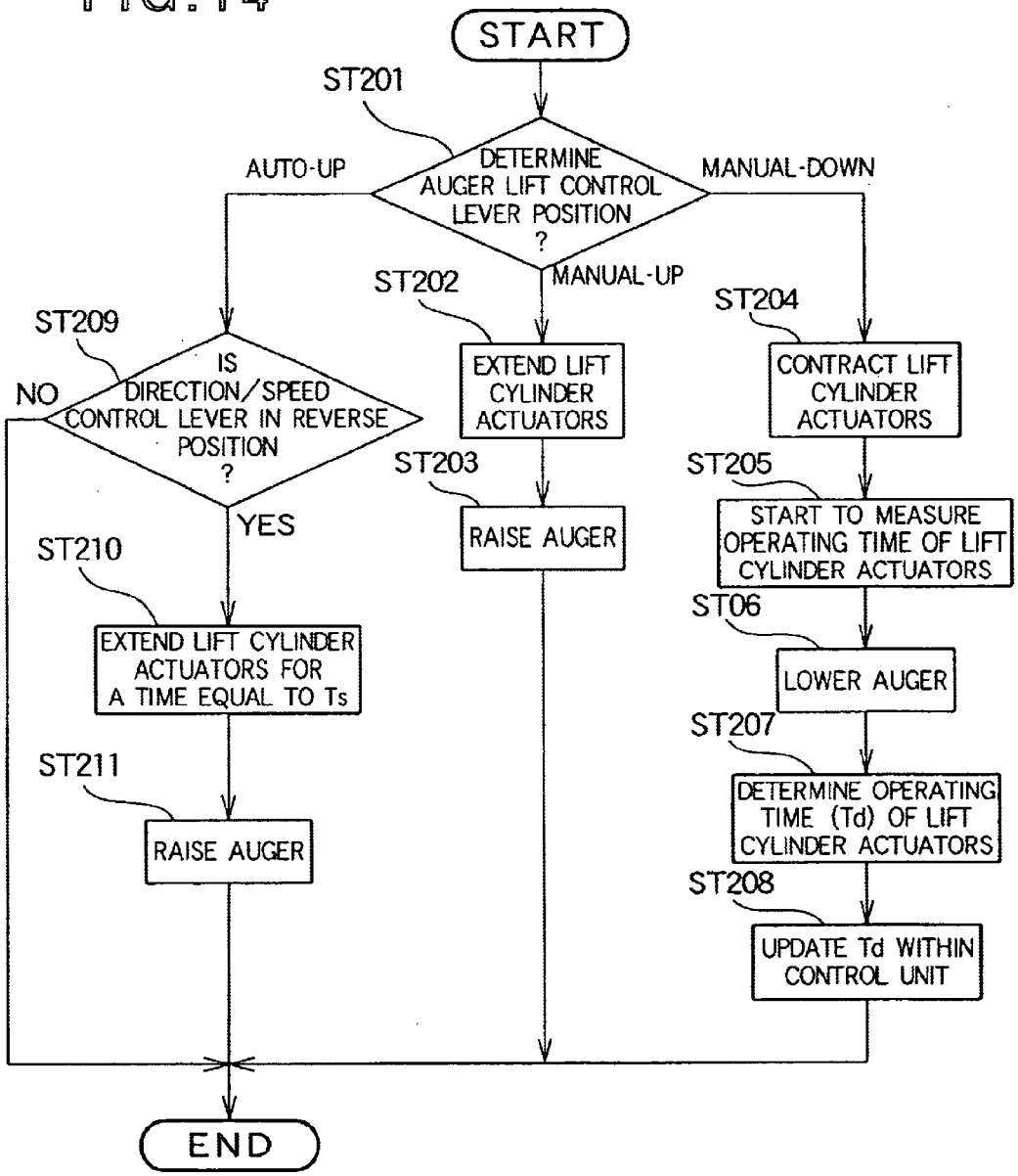
FIG. 14 is a flowchart showing a control procedure achieved by a control unit of the snowplow vehicle shown in FIG. 11.
Figure 16A:
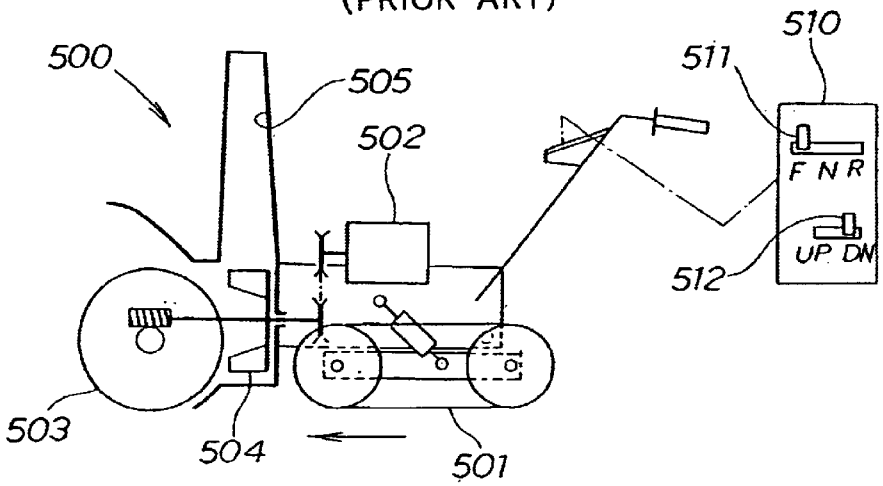
FIG.16A (PRIOR ART)
FIGS. 16A to 16C are diagrammatical views illustrative of the operation of a conventional snowplow vehicle.
Figure 16B:
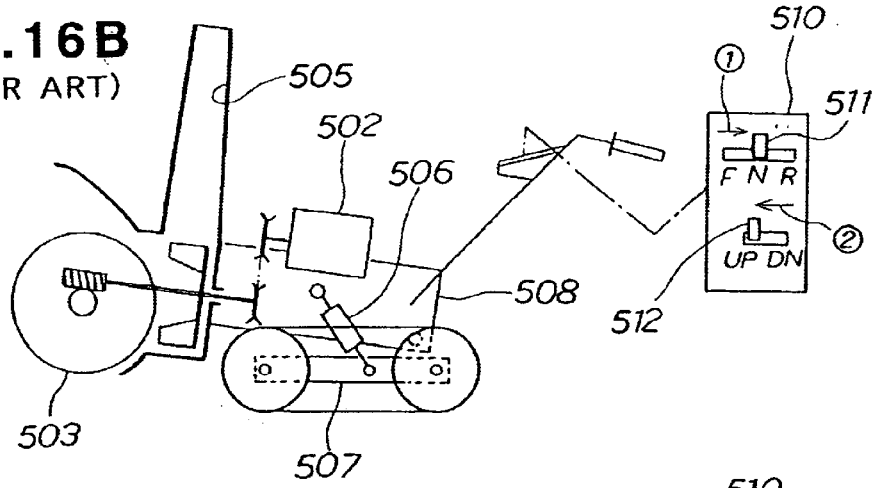
FIG.16B (PRIOR ART)
Figure 16C:
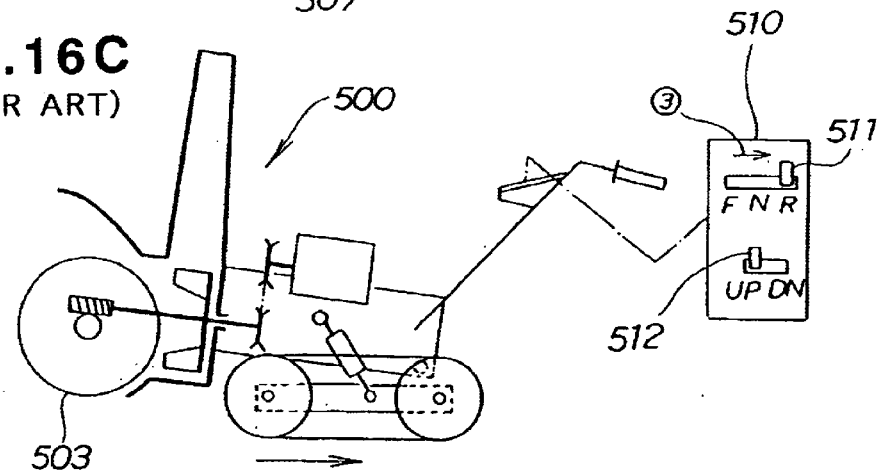
FIG.16C (PRIOR ART)
Figure 17A:
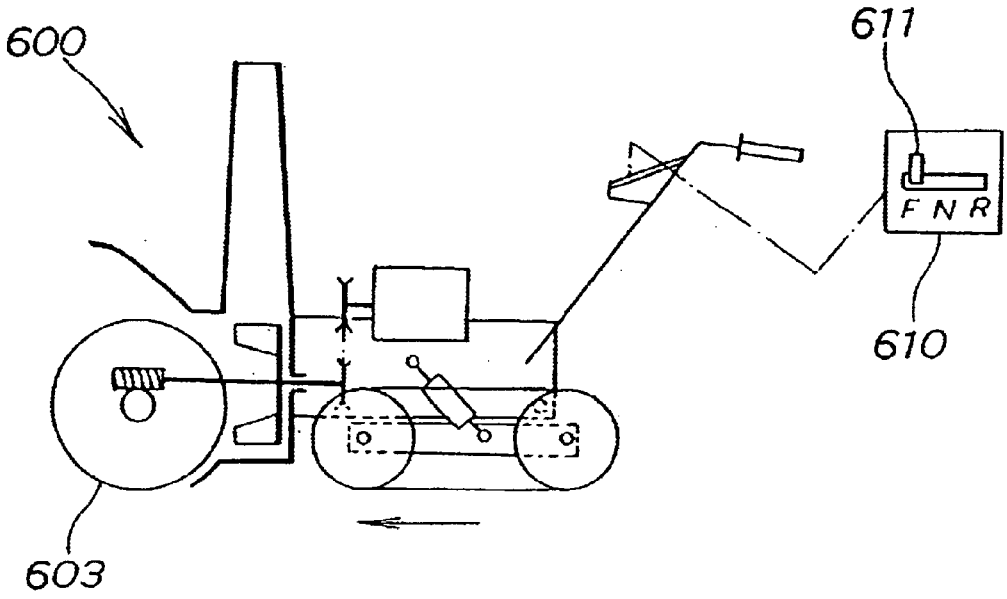
FIG.17A (PRIOR ART)
FIGS. 17A and 17B are diagrammatical views illustrative of the operation of another conventional snowplow vehicle.
Figure 17B:
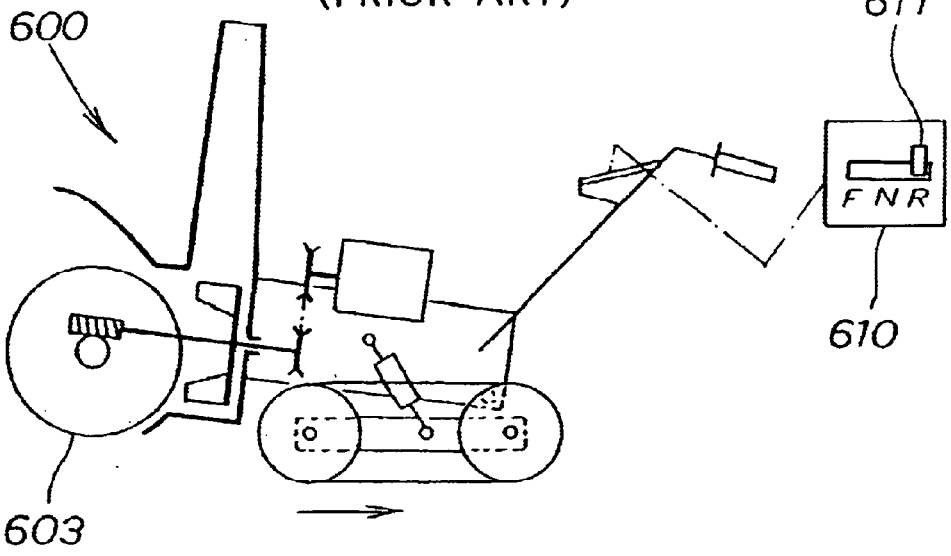
FIG.17B (PRIOR ART)

FIG. 15 is a flowchart showing a modified form of the control procedure shown in FIG. 14. The modified control procedure makes a judgment at ST301 so as to determine the position of the lift control lever 251 (FIG. 13), which may take one position among the auto-up position, the manual-up position and the manual-down position. When the lift control lever 251 is disposed in the manual-up position and, hence, the manual-up mode of operation is selected, the control procedure advances to ST302 where the lift cylinder actuators 233L, 233R are extended with the result that the auger 231 is raised to an elevated position.

When the result of judgment at ST301 indicates that the lift control lever 251 is disposed in the manual-down position and, hence, the manual-down mode of operation is selected, the control procedure branches to ST304 where the lift cylinder actuators 233L, 233R are contracted. ST304 is followed by ST305 where the measurement of operating time of the lift cylinder actuators 233L, 233R is started by using a dock function of the control unit 245. Stated more specifically, a motor current flowing through the electric motor of one lift cylinder actuator 233L or 233R is monitored, and when the motor current exceeds a predetermined value, the internal dock of the control unit 245 starts to measure time (operating time of the lift cylinder actuators 233L, 233R). As a result of contracting movement of the lift cylinder actuators 233L, 233R, the auger 231 is moved downward at ST306. When the lift control lever 251 is shifted from the manual-down position to the auto-up position or the manual-up position, downward movement of the auger 231 is stopped. At this time, ST307 determines an operating time Td of the lift cylinder actuators 233L, 233R, which starts when the motor current exceeds the predetermined value and is ended when the auto-up position or the manual-up position is selected by the lift control lever 251. The operating time Td thus determined is stored in the control unit 245 at ST308. The stored operating time Td is updated each time a shift from the manual-down mode to another operation mode occurs.

When the result of judgment at ST301 indicates that the lift control lever 251 is disposed in the auto-up position and, hence, the auto-up operation mode is selected, the control procedure branches to ST309 where a judgment is made to determine whether or not the auger clutch 236 is in the "on" or engaged state. When the result of judgment is "NO", this means that the auger clutch 236 is in the "off" or disengaged state. In this condition, the auger 231 and the blower 232 are not rotating and, hence, they do not exert any load on the engine 235. Accordingly, from the viewpoint of engine load, there is no difficulty caused from the forward or reverse movement of the snowplow vehicle with the auger kept in the lowermost horizontal position. Thus, the control procedure is terminated.

When the judgment result at ST309 is "YES", this means that the auger clutch 236 is in the "on" or engaged state. In this condition, since the auger 231 and the blower 232 are rotating, they may exert influences on the engine load. Accordingly, the control procedure goes to ST310 where a judgment is made to determine whether or not the travel control lever 253 (FIG. 13) is in the "DRIVE" position. When the result of judgment is "NO", this means that the travel control lever 253 is in the "STOP" position. In this condition, since the snowplow vehicle 210 is not moving in either direction, the rotating auger 231 does not give any influence on the engine load even when it is disposed in the lowermost horizontal position. Thus, the control procedure is terminated.

When the judgment result at ST310 is "YES", this means that the travel control lever 253 is in the "DRIVE" position. In this condition, since the snowplow vehicle 210 is running in either direction, the rotating auger 231 may exert negative influence on the engine load if it is disposed in the lowermost horizontal position. Thus, the control procedure further advances to ST311 where a judgment is made to determine whether or not the direction/speed control lever 254 (FIG. 13) is in the "REVERSE" position. If the result of judgment is "NO", this means that the direction/speed control lever 254 is in the "FORWARD" position. In this condition, since the snowplow vehicle 210 is moving forward to achieve, for example, the snow-removing operation, automatic rising of the rotating auger 231 is not necessary. Accordingly, the control procedure is terminated.

When the judgment result at ST311 is "YES", this means that the direction/speed control lever 254 is in the "REVERSE" position. In this condition, since the snowplow vehicle 210 is to be moving backward while rotating the auger 231, the auger 231 will excessively increase engine load if it is disposed in the lowermost horizontal position. To preclude the occurrence of this problem, the control procedure goes on to ST312 where the lift cylinder actuators 233L, 233R are extended for a time which is equal the operating time Td stored in the control unit 245 at ST308. By thus extending the lift cylinder actuators 233L, 233R, the auger 231 is raised to the elevated intermediate position at ST313. The auger 231 is thus automatically returned to the previous position, so that there is no fear of interference occurring between the auger 231 and snow when the snowplow vehicle is moving backwards.

In the control procedure shown in the flowchart of FIG. 15, the order or sequence of ST309 to ST311 may be changed. It will be appreciated from the foregoing description that the lift cylinder actuators 233L, 233R are operated to raise the auger 213 when at least three items of information have been received in the control units 245. The first information item is obtained at ST301 and represents that the set-up operation mode has been selected. The second information item is obtained at ST311 and represents that the snowplow vehicle 210 is to be moved backward. The third information item is obtained at ST309 and represents that the auger clutch 236 disposed between the power source or engine 235 and the snow-removing mechanism 231, 232 is in the "on" or engaged state. In the auto-up operation mode, the auger 231 is raised to the elevated intermediate position and not to the uppermost inclined position. Accordingly, when the auto-up operation mode is followed by the manual-down operation mode, the auger 231 can be lowered to the lowermost horizontal position in a relatively short time. This will increase the efficiency of the snow-removing operation.

Furthermore, according to the modified control procedure shown in FIG. 15, when the auto-up operation mode is selected, if the anger clutch 236 is in the "off" or disengaged state, the auger 231 and the blower 232 are not raised even though the snowplow vehicle is to be moved backward. There is no difficulty caused from the snowplow vehicle 210 moving backward with the auger 231 and the blower 232 disposed in the lowermost horizontal position so long as the auger 231 and the blower 232 are not operating. As a result, in the snowplow vehicle involving frequently repeated forward and reverse movements, it is possible to reduce the number of operations required to automatically raise the auger 231 and the blower 232 to the elevated intermediate position. This will reduce the number of on-off operations of the auger clutch 236 and elongate the service life of the auger clutch 236, correspondingly. The auto-up operation necessarily reduces the load on the human operator.

The auger clutch 236 should by no means be limited to the belt clutch structure shown in FIGS. 12A and 12B but may include an electromagnetic clutch, a mechanical gear teeth clutch and the like. Furthermore, the power source used for driving the auger 231 and the blower 232 is in the form of an engine 235. The engine 235 may be replaced by an electric motor. Similarly, the power source used for propelling the snowplow vehicle 210 is comprised of electric motors 226L, 226R. The electric motors 226L, 226R may be replaced with an engine.

In the embodiment shown in FIG. 11, the lift cylinder actuators 233L, 233R are designed to extend and contract at the same speed, so that the amount of upward movement of the auger 231 and the amount of downward movement of the auger 231 can be made equal to each other by determining an operating time Td of these cylinder actuators 233L, 233R. In the case where the speed of extension and the speed of contraction of the cylinder actuators 233L, 233R are different from each other, a stroke sensor (not shown) may be associated with one of the cylinder actuators 233L, 233R so as to determine the amounts of extension and contraction of the cylinder actuators 233L, 233R.

Obviously, various minor changes and modifications of the present invention are possible in the light of the above teaching. It is therefore to be understood that within the scope of the appended claims, the present invention may be practiced otherwise than as specifically described.

The present disclosure relates to the subject matters of Japanese Patent Applications Nos. 2001-276075, 2001-301013, and 2001-301228, filed Sep. 12, 2001, Sep. 28, 2001 and Sep. 28, 2001, respectively, the disclosures of which are expressly incorporated herein by reference in their entireties.

What is claimed is:

1. A self-propelled snowplow vehicle comprising:

a propelling frame equipped with driving wheels for driving the snowplow vehicle;

a vehicle frame equipped with an auger at a front end portion thereof for removing snow, the vehicle frame being pivotally connected to the propelling frame;

a frame lift mechanism for lifting the front end portion of the vehicle frame up and down relative to the propelling frame, the frame lift mechanism including an electro-hydraulic cylinder actuator having a piston rod and an electric motor rotatably driven to produce a fluid pressure for reciprocating the piston rod between a fully contracted position and fully extended position;

an operation switch manually activated to drive the electric motor in either direction; and a control unit for controlling operation of the electric motor thereby to control operation of the frame lift mechanism, the control unit being arranged to add up running times of the electric motor when a total sum of the running times reaches a predetermined reference value.

2. A self-propelled snowplow vehicle according to claim 1, wherein the total sum (Tm) of the running times is obtained by the expression $$Tm=Tr-Ts$$

where Tr represents an accumulated total of the running times during which the electric motor is rotating, and Ts represents an accumulated total of the rest times during which the electric motor is at a standstill.

3. A self-propelled snowplow vehicle according to claim 2, wherein the control unit continues to stop the electric motor until a preset fixed time has passed after forcible stop of the electric motor.

4. A self-propelled snowplow vehicle according to claim 3, wherein the running times of the electric motor have a fixed value and are added up at the lapse of a unit time, and the rest times of the electric motor have a fixed value and are added up at the lapse of the unit time, and wherein the fixed value of the running times is larger than the fixed value of the rest times.

5. A self-propelled snowplow vehicle according to claim 2, wherein the running times of the electric motor have a fixed value and are added up at the lapse of a unit time, and the rest times of the electric motor have a fixed value and are added up at the lapse of the unit time, and wherein the fixed value of the running times is larger than the fixed value of the rest times.

6. A self-propelled snowplow vehicle according to claim 1, wherein the control unit continues to stop the electric motor until a preset fixed time has passed after forcible stop of the electric motor.

7. A self-propelled snowplow vehicle according to claim 6, wherein the running times of the electric motor have a fixed value and are added up at the lapse of a unit time.

8. A self-propelled snowplow vehicle according to claim 1, wherein the running times of the electric motor have a fixed value and are added up at the lapse of a unit time.

9. A self-propelled snowplow vehicle comprising:

a propelling frame equipped with driving wheels for driving the snowplow vehicle;

a vehicle frame equipped with an auger at a front end portion thereof for removing snow, the vehicle frame being pivotally connected to the propelling frame;

a frame lift mechanism for lifting the front end portion of the vehicle frame up and down relative to the propelling frame, the frame lift mechanism including an electro-hydraulic cylinder actuator having a piston rod and an electric motor rotatably driven to produce a fluid pressure for reciprocating the piston rod between a fully contracted position and a fully extended position;

an operation switch manually activated to drive the electric motor in either direction; and a control unit for controlling operation of the electric motor thereby to control operation of the frame lift mechanism;

wherein the snowplow vehicle has three modes of operation including a manual-up mode in which the auger is raised manually, a manual-down mode in which the auger is lowered manually, and an auto-up mode in which the auger is automatically raised, and wherein the control unit is arranged such that when the manual-down mode is selected, the control unit determines and stores an amount of contraction of the piston rod achieved in the selected manual-down mode, and when the manual-down mode is followed by the auto-up mode and information representing reversing of the direction of rotation of the driving wheels is received, the control unit performs an auto-up control of the piston rod in which the piston rod is extended by an amount equal to the amount of contraction of the piston rod determined with respect to the preceding manual-down mode.

10. A self-propelled snowplow vehicle according to claim 9, wherein the piston rod of the electro-hydraulic cylinder actuator is extended and contracted at the same speed, and the amount of contraction of the piston rod is determined depending on time.

11. A self-propelled snowplow vehicle according to claim 10, wherein when the piston rod of the cylinder actuator is in the fully extended position, the auger is disposed in an uppermost inclined position, and when the piston rod of the cylinder actuator is in the fully contracted position, the auger is disposed in a lowermost horizontal position, and wherein in the auto-up mode, the auger is raised to an elevated position located intermediately between the uppermost inclined position and the lowermost horizontal position.

12. A self-propelled snowplow vehicle according to claim 11, further including a power source for supplying rotational power to the auger and an auger clutch disposed between the power source and the auger for transmitting the rotational power from the power source to the auger, wherein when the auger clutch is in a disengaged state, the control unit disables the auto-up control of the piston rod of the cylinder actuator.

13. A self-propelled snowplow vehicle according to claim 10, further including a power source for supplying rotational power to the auger and an auger clutch disposed between the power source and the auger for transmitting the rotational power form the power source to the auger, wherein when the auger clutch is in a disengaged state, the control unit disables the auto-up control of the piston rod of the cylinder actuator.

14. A self-propelled snowplow vehicle according to claim 9, wherein when the piston rod of the cylinder actuator is in the fully extended position, the auger is disposed in an uppermost inclined position, and when the piston rod of the cylinder actuator is in the fully contracted position, the auger is disposed in a lowermost horizontal position, and wherein in the auto-up mode, the auger is raised to an elevated position located intermediately between the uppermost inclined position and the lowermost horizontal position.

15. A self-propelled snowplow vehicle according to claim 14, further including a power source for supplying rotational power to the auger and an auger clutch disposed between the power source and the auger for transmitting the rotational power from the power source to the auger, wherein when the auger clutch is in a disengaged state, the control unit disables the auto-up control of the piston rod of the cylinder actuator.

16. A self-propelled snowplow vehicle according to claim 9, further including a power source for supplying rotational power to the auger and auger clutch disposed between the power source and the auger for transmitting the rotational power from the power source to the auger, wherein when the auger clutch is in a disengaged state, the control unit disables the auto-up control of the piston rod of the cylinder actuator.

17. A self-propelled snowplow vehicle comprising:

a propelling frame equipped with driving wheels for driving the snowplow vehicle;

a vehicle frame equipped with an auger at a front end portion thereof for removing snow, the vehicle frame being pivotally connected to the propelling frame;

a frame lift mechanism for lifting the front end portion of the vehicle frame up and down relative to the propelling frame, the frame lift mechanism including an electro-hydraulic cylinder actuator having a piston rod and an electric motor rotatably driven to produce a fluid pressure for reciprocating the piston rod between a fully contracted position and a fully extended position;

an operation switch manually activated to drive the electric motor in either direction; and a control unit for controlling operation of the electric motor thereby to control operation of the frame lift mechanism, the control unit being arranged to forcibly stop the electric motor when a predetermined time has elapsed after the operation switch is activated, the predetermined time being equal to an operating time of the cylinder actuator which is required to extend or contract the piston rod over a maximum stroke defined between the fully extended position and fully contracted position.

18. A self-propelled snowplow vehicle according to claim 17, wherein the control unit continues to stop the electric motor when the operation switch is still in the activated state even after the lapse of the predetermined time.

* * * * *